US009052643B2

(12) United States Patent
Bisaiji et al.

(10) Patent No.: US 9,052,643 B2
(45) Date of Patent: Jun. 9, 2015

(54) IMAGE FORMING METHOD AND IMAGE FORMING APPARATUS FOR TRANSFORMING A TONER IMAGE INTO A SEMI-FILM

(71) Applicants: Takashi Bisaiji, Kanagawa (JP); Hiroomi Tamura, Kanagawa (JP); Hirokatsu Suzuki, Kanagawa (JP); Takamasa Ozeki, Kanagawa (JP); Satoru Ishikake, Kanagawa (JP)

(72) Inventors: Takashi Bisaiji, Kanagawa (JP); Hiroomi Tamura, Kanagawa (JP); Hirokatsu Suzuki, Kanagawa (JP); Takamasa Ozeki, Kanagawa (JP); Satoru Ishikake, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 37 days.

(21) Appl. No.: 13/705,559

(22) Filed: Dec. 5, 2012

(65) Prior Publication Data

US 2013/0164053 A1 Jun. 27, 2013

(30) Foreign Application Priority Data

Dec. 6, 2011 (JP) ..... 2011-266802

(51) Int. Cl.

| | |
|---|---|
| ***G03G 15/16*** | (2006.01) |
| ***G03G 13/16*** | (2006.01) |
| ***G03G 15/01*** | (2006.01) |
| *G03G 15/34* | (2006.01) |

(52) U.S. Cl.

CPC ..... *G03G 15/16* (2013.01); *G03G 13/16* (2013.01); *G03G 15/0189* (2013.01); *G03G 15/1605* (2013.01); *G03G 15/169* (2013.01); *G03G 15/348* (2013.01)

(58) Field of Classification Search

CPC . G03G 15/1605; G03G 15/169; G03G 15/16; G03G 13/16; G03G 15/0189; G03G 15/348

USPC ..... 399/127, 296, 302, 308, 318

See application file for complete search history.

(56) References Cited

U.S. PATENT DOCUMENTS 5,999,201 A * 12/1999 Dalal et al. ..... 347/115
6,203,953 B1 * 3/2001 Dalal ..... 430/47.2

(Continued)

FOREIGN PATENT DOCUMENTS

JP 11015279 A * 1/1999
JP 11174778 A * 7/1999

(Continued)

OTHER PUBLICATIONS

The Imaging Society of Japan, "Electrophotography", Tokyo Denki University Press, Jun. 20, 2008, pp. 78-97 with English translation.

*Primary Examiner* — Robert Beatty

(74) *Attorney, Agent, or Firm* — Oblon, McClelland, Maier & Neustadt, L.L.P.

(57) ABSTRACT

The image forming method comprising: forming a toner image on an image carrier; transferring the toner image formed on the image carrier onto a recording medium; and transforming the toner image on the image carrier into a semi-film by applying a pressure. And the image forming apparatus comprising: an image carrier; a toner image forming unit configured to form a toner image on the image carrier; a transfer unit configured to transfer the toner image formed on the image carrier onto a recording medium; and a toner image transforming unit configured to transfer the toner image on the image carrier into a semi-film by applying a pressure to the toner image.

8 Claims, 14 Drawing Sheets

(56) References Cited

U.S. PATENT DOCUMENTS

| | | | | |
|---|---|---|---|---|
| 7,233,762 | B2 * | 6/2007 | Kunii et al. | 399/307 |
| 7,809,317 | B2 * | 10/2010 | Someya et al. | 399/307 |
| 7,917,070 | B2 * | 3/2011 | Shimizu et al. | 399/307 |
| 2003/0219670 | A1 | 11/2003 | Sawada et al. | |
| 2007/0184377 | A1 | 8/2007 | Shu et al. | |

FOREIGN PATENT DOCUMENTS

| | | | |
|---|---|---|---|
| JP | 2001272866 | A * | 10/2001 |
| JP | 2008076469 | A * | 4/2008 |
| JP | 2010-191197 | | 9/2010 |
| JP | 2010-204358 | | 9/2010 |
| JP | 2011197331 | A * | 10/2011 |

* cited by examiner

IMAGE FORMING METHOD AND IMAGE FORMING APPARATUS FOR TRANSFORMING A TONER IMAGE INTO A SEMI-FILM

CROSS-REFERENCE TO RELATED APPLICATIONS

The present application claims priority to and incorporates by reference the entire contents of Japanese Patent Application No. 2011-266802 filed in Japan on Dec. 6, 2011.

BACKGROUND OF THE INVENTION

1. Field of the Invention

The present invention relates to an image forming method and an image forming apparatus.

2. Description of the Related Art

An image forming apparatus using electrophotography, which is represented by the Carlson process, has been conventionally known. Such an image forming apparatus uniformly charges a photosensitive element having photoconductivity, and forms a latent image using exposing light corresponding to an image pattern as an electric charge distribution, and visualizes the latent image using resin coloring fine particles (hereinafter, referred to as toner) that are positively or negatively charged. The toner is then transferred onto the surface of a transfer medium such as a transfer sheet by an electrostatic force, and the transfer medium is passed between rollers to which a pressure is applied, to allow the image to be fixed onto the transfer medium due to the elasticity of the toner, and to achieve the final toner image.

As a method for fixing a toner image onto a transfer sheet, a method using thermal energy is widely practiced.

However, thermal fixing using thermal energy uses 60 percent or more of the power consumed by an image forming apparatus. Because the fixing has a large impact on energy saving, technologies such as that disclosed in "Denshi Shashin (Electrophography)", Tokyo Denki University Press, pp. 78-96 have been developed to reduce energy consumption in the fixing.

Japanese Patent Application Laid-open No. 2010-191197 and Japanese Patent Application Laid-open No. 2010-204358 disclose an image forming apparatus in which a toner image is fixed onto a transfer sheet with a pressure. In the image forming apparatus disclosed in Japanese Patent Application Laid-open No. 2010-191197 and Japanese Patent Application Laid-open No. 2010-204358, a pressure is applied to a toner image on an intermediate transfer belt being an image carrier to transform the toner image into a film, and the film being the toner image is transferred onto the transfer sheet. Transforming a toner image into a film herein means a condition in which a toner image can be integrally removed from the intermediate transfer belt when the toner image on the intermediate transfer belt is lifted with a pair of tweezers. By transforming the toner image on the intermediate transfer belt into a film, toner scattering in transferring the toner image onto transfer sheet, or incomplete images, e.g., missing toner around a character, can be prevented.

However, in order to transform a toner image into a film in the manner disclosed in Japanese Patent Application Laid-open No. 2010-191197 and Japanese Patent Application Laid-open No. 2010-204358, toner particles making up the toner image need to be fused. Therefore, a large pressure needs to be applied to the toner image. As a result, the driving load of the intermediate transfer belt is increased, disadvantageously.

This problem is inherent in any structure that transforms a toner image on an image carrier into a film, without any limitations to an intermediate transfer belt.

The present invention is made in consideration of above, and an object of the present invention is to provide an image forming apparatus that can suppress toner scattering and incomplete images, and reduce driving load of an image carrier.

SUMMARY OF THE INVENTION

It is an object of the present invention to at least partially solve the problems in the conventional technology.

An image forming method comprising: forming a toner image on an image carrier; transferring the toner image formed on the image carrier onto a recording medium; and transforming the toner image on the image carrier into a semi-film by applying a pressure.

An image forming apparatus comprising: an image carrier; a toner image forming unit configured to form a toner image on the image carrier; a transfer unit configured to transfer the toner image formed on the image carrier onto a recording medium; and a toner image transforming unit configured to transfer the toner image on the image carrier into a semi-film by applying a pressure to the toner image.

Herein and hereinafter, being transformed into a semi-film means that toner particles making up the toner image are not completely fused, and the toner image breaks off when the toner image is lifted using tweezers.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment in which the present invention is applied to a copying machine being an image forming apparatus will now be explained.

Figure 1:
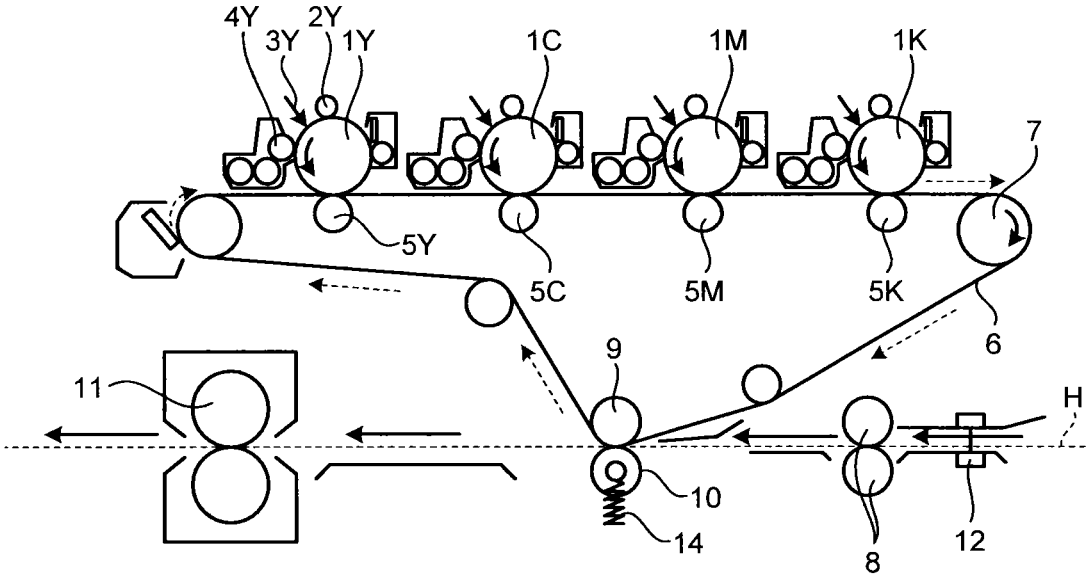
FIG. 1 is a schematic illustrating a general structure of an image forming unit included in a copying machine according to an embodiment of the present invention.

FIG. 1 is a schematic illustrating a general structure of an image forming unit included in the copying machine according to the embodiment. The copying machine is a tandem-type image forming apparatus having a photosensitive element being a latent image carrier for each color of yellow (Y), cyan (C), magenta (M), and black (K). In FIG. 1, members corresponding to each of these colors are appended with a sign Y, C, M, or K to distinguish the colors, but members for each of the colors are substantially the same. Therefore, in the detailed description, the signs for distinguishing the color are omitted.

A photosensitive element 1 has a surface charged to a uniform potential by a charging unit 2. An exposing unit not illustrated applies writing exposure 3 to the surface of the photosensitive element based on information of an image to be formed, separately for an image part and a non-image part. In this manner, an electrostatic latent image is formed on the surface of the photosensitive element 1. In other words, in the embodiment, the charging unit 2 and the exposing unit make up a latent image forming unit. Toner is attached to the image part of the electrostatic latent image on the surface of the photosensitive element thorough a developing process performed by a developing unit 4 being a developing unit, to achieve a toner image. The toner image is then transferred onto an intermediate transfer belt 6 being an image carrier in a primary transfer unit being a primary transfer unit.

Each of the photosensitive elements 1 are arranged along a moving path of the surface of the intermediate transfer belt 6, in a manner held in contact with the intermediate transfer belt, and the toner images formed on the respective photosensitive elements are sequentially transferred onto the intermediate transfer belt at the respective primary transfer units, in a manner registered with respect to each other. The intermediate transfer belt is stretched across and driven by a plurality of rollers including a driving roller 7. The driving roller is driven in rotation by a driving motor being a driving source.

A full-color toner image formed on the intermediate transfer belt is transferred onto a transfer sheet being a recording medium carried through a conveying path H in the direction indicated by the arrow illustrated in FIG. 1 in a secondary transfer unit being a transfer unit. The transfer sheet is fed from a paper feeding unit not illustrated included in the image forming apparatus, has its leading end registered by a registration roller pair 8, and is sent into the secondary transfer unit. The transfer sheet having a toner image transferred is passed through a fixing unit 11 being a fixing unit, and the toner image is fixed onto the transfer sheet.

Used in the embodiment is a toner that includes a resin in which fluidity emerges due to a phenomenon called phase transition when a pressure stimulation is applied (hereinafter, referred to as "pressure-phase transition resin"), and the fixing unit 11 uses a pressure to fix a toner image onto a transfer sheet.

Figure 2:
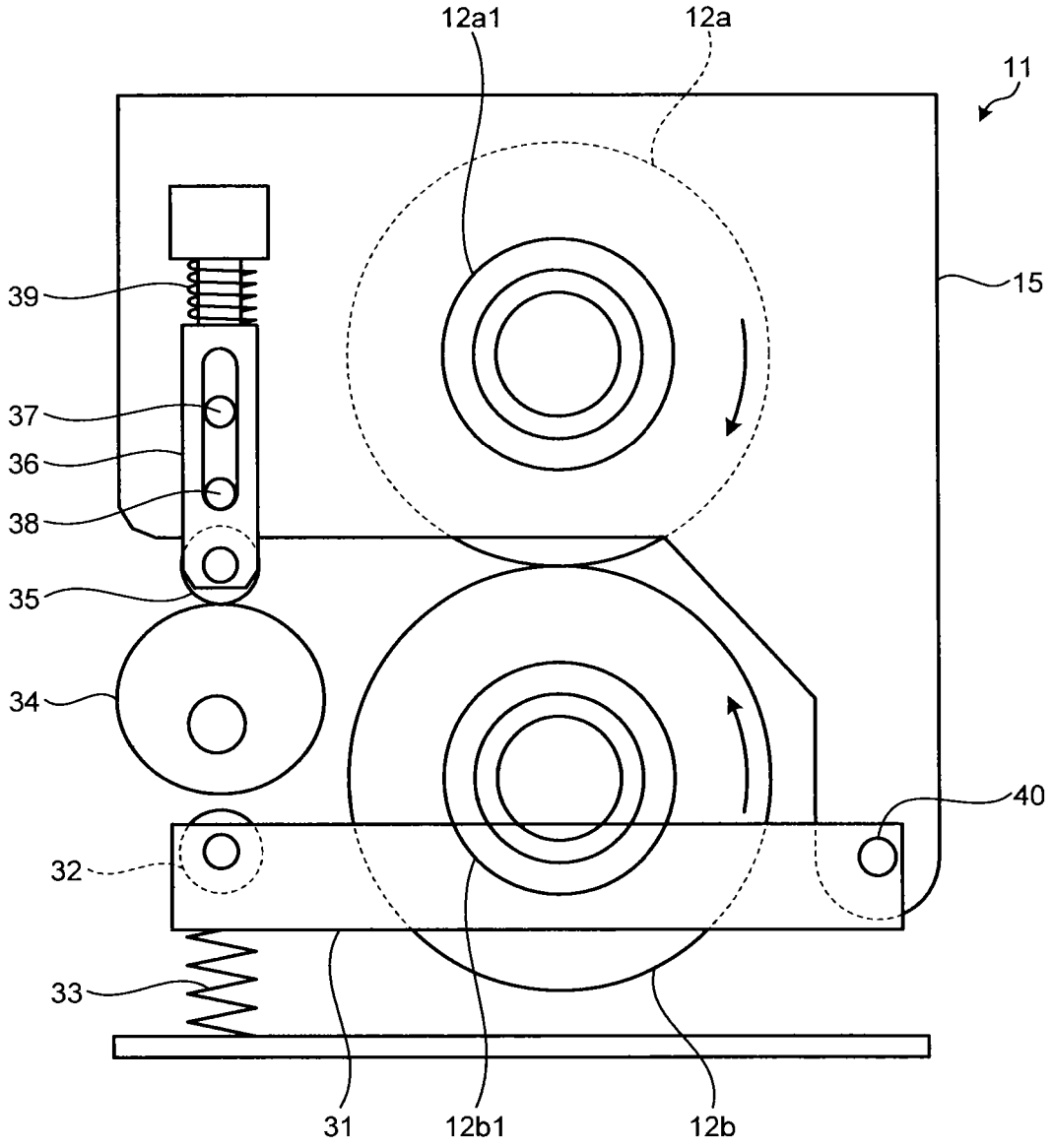
FIG. 2 is a general schematic of a structure of a fixing unit.

FIG. 2 is a general schematic of a structure of the fixing unit 11.

The fixing unit 11 includes a pressing roller pair having a metallic upper roller 12*a* with a smooth surface and a metallic lower roller 12*b* with a smooth surface, and an applied pressure adjusting mechanism for adjusting a pressure applied by the pressing roller pair.

The applied pressure adjusting mechanism includes a lever 31 having one end supported about a fulcrum 40 on a housing 15 of the fixing unit 11 and the other end supported by a compressed spring 33. At an approximate center of the lever 31, a shaft bearing 12*b*1 of the lower roller 12*b* in pressing roller pair 12 is supported, and a roller 32 abutting against a cam 34 is provided at the end of the lever 31 supported by the compressed spring 33. The lever 31 is configured to be swung by rotations of the cam 34 (rotated by a motor or the like not illustrated). Provided on the opposite side of the lever 31 across the cam 34 is an arm 36 supported by shafts 37 and 38 provided to the housing 15 of the fixing unit 11 and by a compressed spring 39. A roller 35 provided at the tip of the arm 36 abuts against the cam 34. Such a structure enables the pressure generated between the upper roller 12*a* and lower roller 12*b* to be adjusted based on the rotation of the cam 34. In FIG. 2, a numeral 12*a*1 indicates a shaft bearing of the upper roller 12*a*, the shaft bearing 12*a*1 is fixed to the housing 15.

Figure 3:
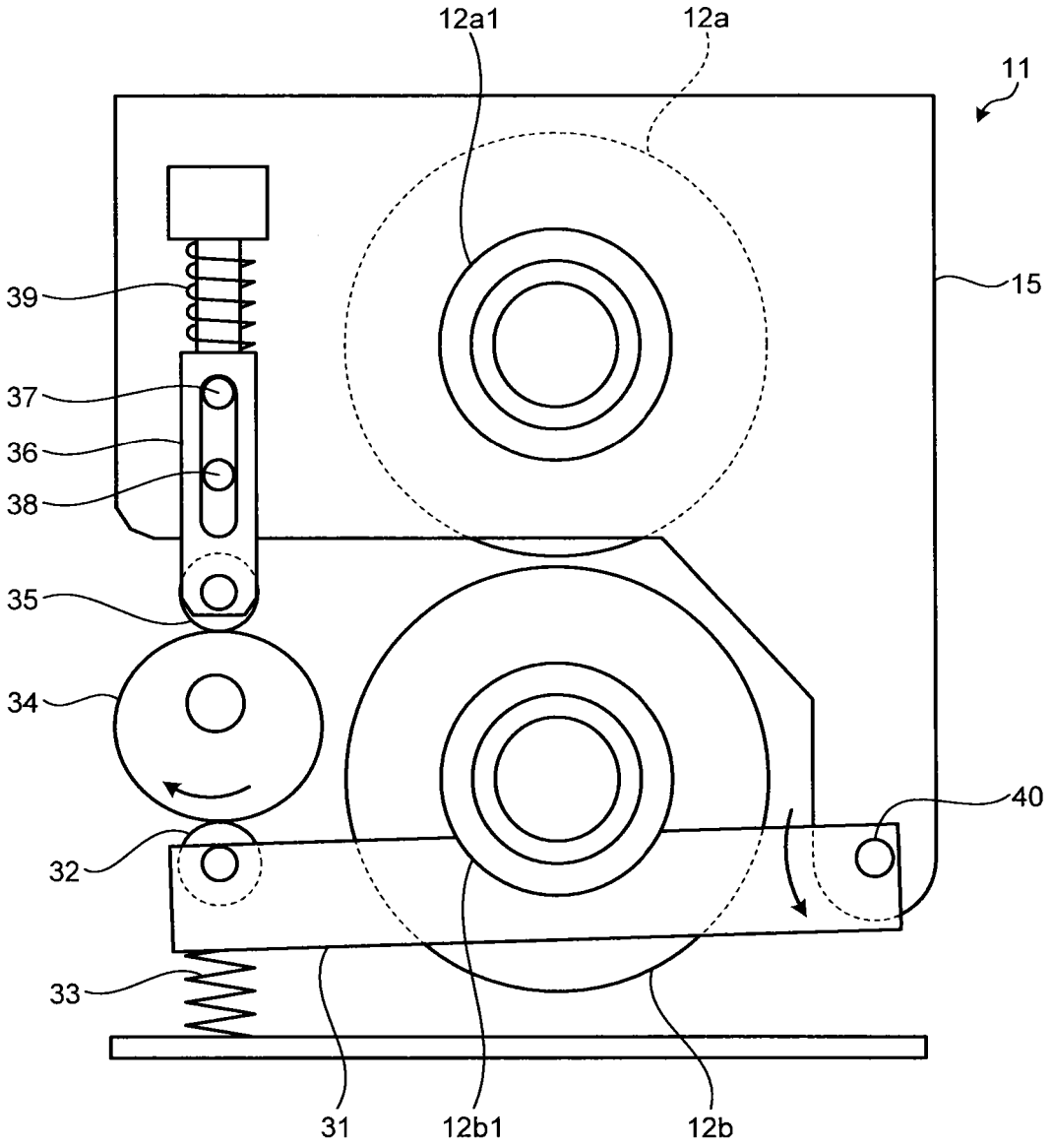
FIG. 3 is a schematic illustrating a configuration for reducing a pressure applied by a pressing roller pair included in the fixing unit.

FIG. 3 is a schematic illustrating a configuration for reducing the pressure applied by the pressing roller pair.

As illustrated in FIG. 3, to reduce the pressure applied by the pressing roller pair, the cam 34 is rotated and brought into contact with the roller 32, and causes the cam 34 to press down the lever 31. The lever 31, in turn, is caused to swing about the fulcrum 40 in a counterclockwise direction in FIG. 3, to enable the pressure generated between the upper roller 12*a* and the lower roller 12*b* to be reduced.

The temperature Tb and the pressure Pb in a pressing nip formed by the pressing roller pair when a toner image is fixed onto a transfer sheet are preferably from 15 degrees Celsius to 100 degrees Celsius, and equal to or higher than 5 megapascals and equal to or lower than 100 megapascals, respectively. The pressure equal to or higher than 0.5 megapascal prevents fixing defects, and the pressure equal to or lower than 100 megapascals enables a transfer sheet to be conveyed without any trouble. The temperature and the pressure are not limited to the respective ranges, and may be determined appropriately depending on toner characteristics and a structure of the fixing unit.

The pressure Pb in the pressing nip can be adjusted using the applied pressure adjusting mechanism based on image information.

Figure 4:
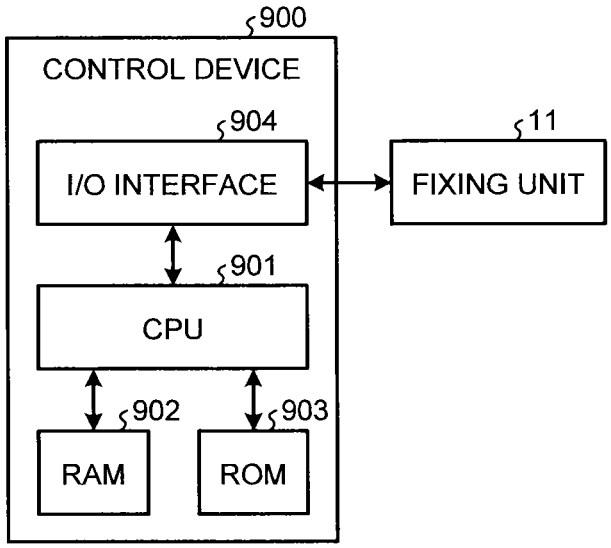
FIG. 4 is a block diagram illustrating an example of a control system for controlling the pressure generated by the pressing roller pair included in the fixing unit based on image information.

FIG. 4 is a block diagram illustrating an example of a control system included in the applied pressure adjusting mechanism for controlling the pressure generated by the pressing roller pair included in the fixing unit 11 based on image information. A control device 900 includes a central processing unit (CPU) 901, a random access memory (RAM) 902, a read-only memory (ROM) 903, and an input-output (I/O) interface 904, for example, and is connected to the fixing unit 11. The control device 900 can control the pressure applied in the fixing unit 11 based on image information, by executing a predetermined control program incorporated in advance.

For example, the control device 900 determines whether an image formed on a transfer sheet is an image formed in a single color or an image formed in a plurality of colors based on the image information. Based on the determination result, the control device 900 changes a setting of the pressure to be generated by the pressing roller pair 12*a* and 12*b* in the fixing unit 11 to a level that is appropriate for each image type, and sends a control signal to the fixing unit 11 based on the setting after the change. The fixing unit 11 changes the pressure generated by the pressing roller pair 12*a* and 12*b* based on the control signal from the control device 900.

Because an image in a plurality of colors generally has a larger amount of attached toner and a thicker layer of toner than a single-colored image, when the image is monochromatic (single-colored), the pressure to be generated by the pressing roller pair 12*a* and 12*b* is set to a lower level, and when the image is colored (multi-colored), the pressure to be generated by the pressing roller pair 12*a* and 12*b* is set to a higher level. In this manner, the pressure to be applied to the transfer sheet is changed to a value that is appropriate for each of these image patterns. In the manner described above, because the control device 900 determines whether the image formed on the transfer sheet is single-colored, and the pressure generated by the pressing roller pair in the fixing unit 11 is automatically changed to an optimal level depending on the difference between images on the transfer sheet, fixing defects due to a lack of pressure or wrinkling caused by an excessive pressure can be prevented.

The control device 900 also determines an image area ratio of the image formed on the transfer sheet based on the image information. Based on the determination result, the control device 900 changes the setting of the pressure generated by the pressing roller pair 12*a* and 12*b* in the fixing unit 11 to a level appropriate for each image, and sends a control signal to the fixing unit 11 based on the setting after the change. The fixing unit 11 changes the pressure generated by the pressing roller pair 12*a* and 12*b* based on the control signal from the control device 900.

The amount of attached toner and the thickness of the toner layer on the transfer sheet increase proportionally to the image area ratio. Therefore, for example, if the image area ratio of each of the colors in the image is equal to or less than a predetermined threshold (for example, 50 percent), the pressure generated by the pressing roller pair 12*a* and 12*b* is set to a lower level, and if the image area ratio exceeds the threshold (for example, 50 percent), the pressure generated by the pressing roller pair 12*a* and 12*b* is set to a higher level. In this manner, the pressure to be applied is changed to a level appropriate for each image area ratio. In the manner described above, the image area ratio of the image formed on a transfer sheet is determined, and the pressure generated by the pressing roller pair 12*a* and 12*b* included in the fixing unit 11 is automatically changed to an optimal level depending on the difference in the image area ratio. Therefore, fixing defects due to a lack of pressure or wrinkling caused by an excessive pressure can be prevented.

Furthermore, a heat source such as a halogen heater being a heat source heating the upper roller may be provided facing the upper roller 12*a*, for example, to allow the heat to be applied supplementarily.

A characterizing feature of the embodiment will now be explained.

In the embodiment, the toner image on the intermediate transfer belt is transformed into a semi-film before the toner image on the intermediate transfer belt is transferred onto the transfer sheet in the secondary transfer unit. Being transformed into a semi-film herein means that toner particles making up the toner image are not completely fused, and the toner image breaks off when the toner image is lifted using tweezers and cannot be integrally removed from the intermediate transfer belt 6. By transforming the toner image on the intermediate transfer belt into a semi-film, toner scattering in the secondary transfer unit and incomplete images can be suppressed.

To suppress the toner scattering in the secondary transfer unit and incomplete images well, it is preferable to transform the toner image on the intermediate transfer belt 6 into a film so that the toner image can be integrally removed from the intermediate transfer belt 6 when the toner image is lifted with tweezers before transferring onto a transfer sheet. This is because, by transforming the toner image into a film, the toner image on the intermediate transfer belt is integrally transferred onto the transfer sheet. Therefore, toner scattering and incomplete images can be suppressed well.

However, to transform a toner image into a film, toner particles making up the toner image need to be fused together. Therefore, a quite high pressure needs to be applied to the toner image. In particular, in order to transform a full-color toner image formed with toners in a plurality of colors superimposed over one another into a film, an extremely high pressure needs to be applied to the toner image. The reason why such a high pressure is required will now be explained.

Figure 5A:
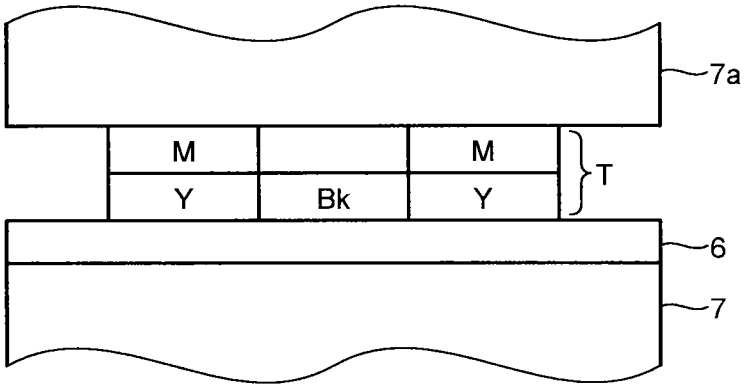
FIGS. 5A to 5C are schematics for explaining a process of transforming a full-color image on an intermediate transfer belt into a film.
Figure 5B:
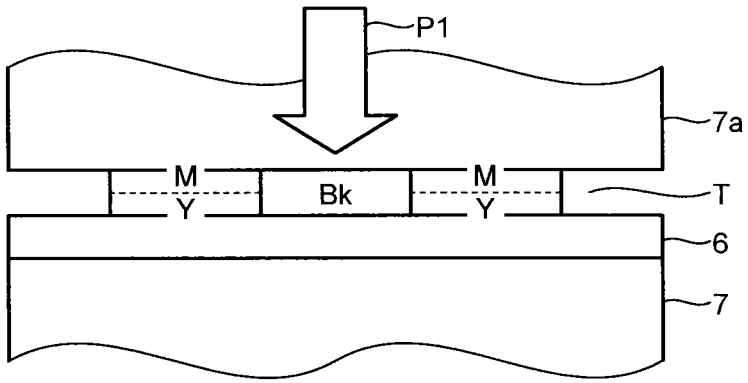
Figure 5C:
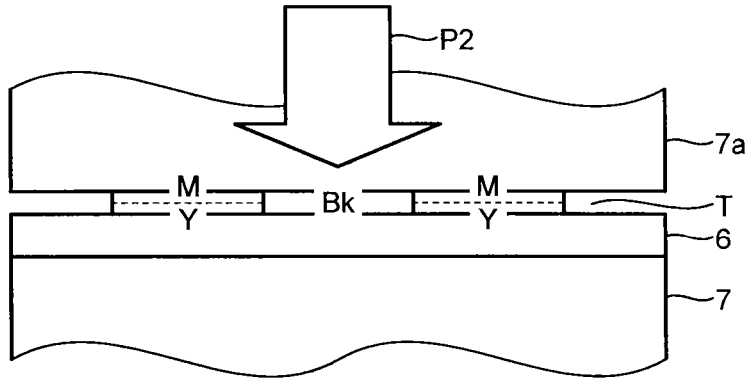

FIGS. 5A to 5C are schematics for explaining a process of transforming a full-color image on the intermediate transfer belt 6 into a film. Explained in FIGS. 5A to 5C is an example in which a pressing roller 7*a* is used to transform the toner image into a film by applying a pressure to the toner image on the intermediate transfer belt at a position facing the driving roller 7, nipping the intermediate transfer belt 6 therebetween.

As illustrated in FIG. 5A, a full-color toner image T on the intermediate transfer belt has a two-colored portion colored by toners in two colors (for example, red using Y toner and M toner) and a single-colored portion colored by a toner in a single color (for example, black using Bk toner). The height of the single-colored portion is a half of that of the two-colored portion. Therefore, as illustrated in FIG. 5B, even when toner image is pressed at a pressure P1 allowing the two-colored portion to transform into a film, the single-colored portion surrounded by the two-colored portion would not be pressed sufficiently, and the single-colored portion would not be transformed into a film. In order to transform the single-colored portion into a film, a higher pressure P2 is required, as illustrated in FIG. 5C. The pressure P2 would be a pressure equal to or higher than the pressure simply allowing the two-colored portion to transform into a film. Therefore, in order to transform a toner image into a film completely, an extremely high pressure needs to be applied to the toner image T. As a result, a driving load to the intermediate transfer belt 6 is increased, and the driving motor for driving the intermediate transfer belt 6 is increased in size, and drive communicating members such as gears for communicating the driving force to the intermediate transfer belt 6 wear out faster, and the lifetime of a drive communicating unit would be reduced.

In addition, because a high pressure needs to be applied to the toner image, the pressing roller 7*a* is pressed at a high pressure against the surface of the intermediate transfer belt 6 carrying the toner. As a result, when a factor causing a variation in the load on the intermediate transfer belt in the pressing nip between the pressing roller 7*a* and the intermediate transfer belt 6 varies, the load variation is increased. Such an increase in the load variation results in driving unevenness, resulting, in turn, in image quality deterioration, such as a registration error. To explain specifically, if the friction coefficient between the pressing nip, which is a factor causing a load variation, varies due to an image area ratio of the toner image on the intermediate transfer belt or the like, the friction force varies by a larger degree when the pressure is high. As a result, a variation in the driving load is also increased. Furthermore, when the pressure applied by the pressing roller 7*a* is increased, the nip width of the pressing nip is also increased. Therefore, when a factor causing a variation in the load on the pressing nip varies, the load varies by a larger degree. Furthermore, if a hard object is nipped between the pressing nip (e.g., a carrier from the developing unit 4), the hard object could damage the intermediate transfer belt 6.

In response to this issue, in the embodiment, the toner image on the intermediate transfer belt is transformed into just a semi-film so that the pressure applied to the intermediate transfer belt can be reduced. Because the load of driving the intermediate transfer belt 6 is thus reduced, a smaller driving motor with a smaller driving torque can be used. Therefore, the apparatus can be reduced in size. Furthermore, wearing of the drive communicating members, such as a gear for communicating the driving force of the driving motor to the intermediate transfer belt 6, can be suppressed. Therefore, the lifetime of the drive communicating members can be extended.

Furthermore, it becomes unnecessary to use a high pressure to press a pressing member for pressing the toner image on the intermediate transfer belt 6 against the intermediate transfer belt 6. Therefore, when the friction coefficient in the pressing nip varies due to an image area ratio in the toner image on the intermediate transfer belt, for example, the friction force in the pressing nip varies less. As a result, a variation in the driving load for the intermediate transfer belt 6 can be suppressed, and drive unevenness can be suppressed. Furthermore, the nip width of the pressing nip that is the portion where the pressing member and the intermediate transfer belt 6 abut against each other can be reduced. Because the nip width is smaller, even when a factor causing a load variation on the intermediate transfer belt in the pressing nip varies, an impact of such a variation can be reduced, and therefore, a variation in the load on the intermediate transfer belt can be reduced. In this manner, driving unevenness of the intermediate transfer belt 6 can be reduced.

Because the driving unevenness can be suppressed, a registration error due to driving unevenness can be suppressed.

Furthermore, when a hard object is nipped between the pressing nip, the load applied by the hard object to the intermediate transfer belt can be suppressed from concentrating. Therefore, the surface of the intermediate transfer belt 6 can be suppressed from being damaged. Furthermore, because the toner image having transformed into a semi-film can be transferred onto a transfer sheet, toner scattering when the toner image is transferred onto a transfer sheet and incomplete images can be suppressed by a larger degree, compared with when a toner image not transformed into a semi-film is transferred onto a transfer sheet.

It is also possible to transform a toner image on the intermediate transfer belt into a semi-film in the primary transfer unit, or the pressing roller 7*a* may be arranged at a position facing the driving roller 7, as illustrated in FIGS. 5A to 5C, for example, and the toner image on the intermediate transfer belt may be transformed into a semi-film between the primary transfer unit and the secondary transfer unit. However, it is more preferable to transform the toner image into a semi-film in the secondary transfer unit.

This is because, if the toner image is transformed into a semi-film in the primary transfer unit, the pressure in the primary transfer nip would be increased. In addition, despite toner particles are designed to acquire a charged polarity (e.g., negative polarity) for developing an electrostatic latent image, the toner particles could become charged oppositely in the developing unit depending on how the toner is used or some conditions of a recording agent. Such oppositely charged toner could become attached to the non-image part of the photosensitive element 1 (see FIG. 2. 43 in p. 56, "Denshi Shashin" Tokyo Denki Daigaku Shuppan (in the charge distribution of toner with a coverage factor of 50 percent illustrated in FIG. 2. 43, frequencies appear on the positive side of "0" indicating the presence of the oppositely charged toner)).

If a pressure at a level allowing the toner image to be transformed into a semi-film is applied in the primary transfer unit between the intermediate transfer belt 6 and the photosensitive element 1, an adhesive force is generated between the oppositely charged toner attached to the non-image part of the photosensitive element 1 and the intermediate transfer belt 6, and the oppositely charged toner attached to the non-image part of the photosensitive element 1 may be transferred onto the intermediate transfer belt 6. The toner thus transferred might be further transferred onto a transfer sheet in the secondary transfer unit, and might appear in the final image as well. This might cause the image quality to deteriorate, with some smudges in the non-image part. Generally, the surface of the toner particles is covered by micro-particles of silica or oxidized titanium being an external additive. If the toner is applied with a pressure at a level causing the toner to transform into a semi-film, these micro-particles would be buried into the toner. In such a condition, despite fusing of the toner particles are promoted, the adhesive force between the toner and the intermediate transfer belt 6 is increased at the same time. Therefore, the toner in the non-image part could be transferred onto the intermediate transfer belt, in the same manner as the toner in the image part.

Moreover, if the pressing roller 7*a* is arranged at a position facing the driving roller 7 in the manner illustrated in FIGS. 5A to 5C, and the toner image is transformed into a semi-film between the primary transfer unit and the secondary transfer unit, the number of parts are increased.

By contrast, if the toner image on the intermediate transfer belt is transformed into a semi-film in the secondary transfer unit, an increase in the number of parts can be prevented, and the quality of the final image can be suppressed from deteriorating.

Specifically, in the primary transfer unit, the toner image on the photosensitive element is caused to transfer onto the intermediate transfer belt 6 by the effect of a bias applied to a primary transfer roller 5, and the pressure applied to the toner in the transfer area in the primary transfer unit (the area in which the toner on the photosensitive element 1 is brought into contact with the intermediate transfer belt 6) is set to a level equal to or lower than a level which the toner is plastically deformed.

Because the toner image on the photosensitive element is not affected at all while being carried from the development position to the primary transfer unit, the toner sits on the photosensitive element as developed, in other words, with toner attached to the image part based on the electrostatic latent image and toner attached to the non-image part correspondingly to the amount of oppositely charged toner in the developing unit, while each toner particle remains independent. Under this condition, if a bias for generating an electrical field causing the toner on the image part to be transferred onto the intermediate transfer belt by an electrostatic force is applied to the primary transfer roller 5 under a pressure equal to or lower than a level causing the toner to be plastically deformed, only the toner attached to the image part of the photosensitive element 1 is transferred onto the intermediate transfer belt 6, and the oppositely charged toner on the non-image part is left behind on the photosensitive element. This is because an electrostatic force in a direction toward the photosensitive element acts on the oppositely charged toner in the non-image part, and any adhesive force that is larger than the electrostatic force is not generated between the oppositely charged toner and the intermediate transfer belt 6. In this manner, the quality of a final image transferred onto a transfer sheet can be suppressed from deteriorating.

In the secondary transfer unit, a transfer nip is formed between a secondary transfer roller 10 positioned outside of the intermediate transfer belt 6 and a secondary transfer facing roller 9 positioned inside of the belt. An electric filed is generated in the transfer nip to transfer the toner image onto a transfer sheet. The shaft of the secondary transfer roller 10 is biased by a pressing force of a pressing spring 14 in a direction causing the secondary transfer roller 10 to be pressed against the secondary transfer facing roller 9. In order to transform the toner image on the intermediate transfer belt into a semi-film, the secondary transfer roller 10 is pressed against the intermediate transfer belt at a pressure equal to or higher than the level causing the toner to be plastically deformed and equal to or lower than a level causing the toner image to transformed into a film.

Because the toner image on the intermediate transfer belt 6 is transformed into a semi-film in the secondary transfer unit, the electrostatic force in the transfer nip acts on a toner chunk having transformed into a semi-film. Therefore, compared with when independent toner particles are transferred onto a transfer sheet, toner scattering and incomplete images can be reduced, and high quality images can be achieved.

In order to allow the fused toner to some degree on the intermediate belt to be transferred from the intermediate transfer belt onto a transfer sheet at a higher quality, a lubricant (e.g., zinc stearate) may be applied to the surface of the intermediate transfer belt to improve separability. In addition, to improve transferability taking advantage of a shearing force, the speed of the intermediate transfer belt 6 and the speed of the transfer sheet may be made different.

A variation of the embodiment will now be explained.

First Variation

Figure 6:
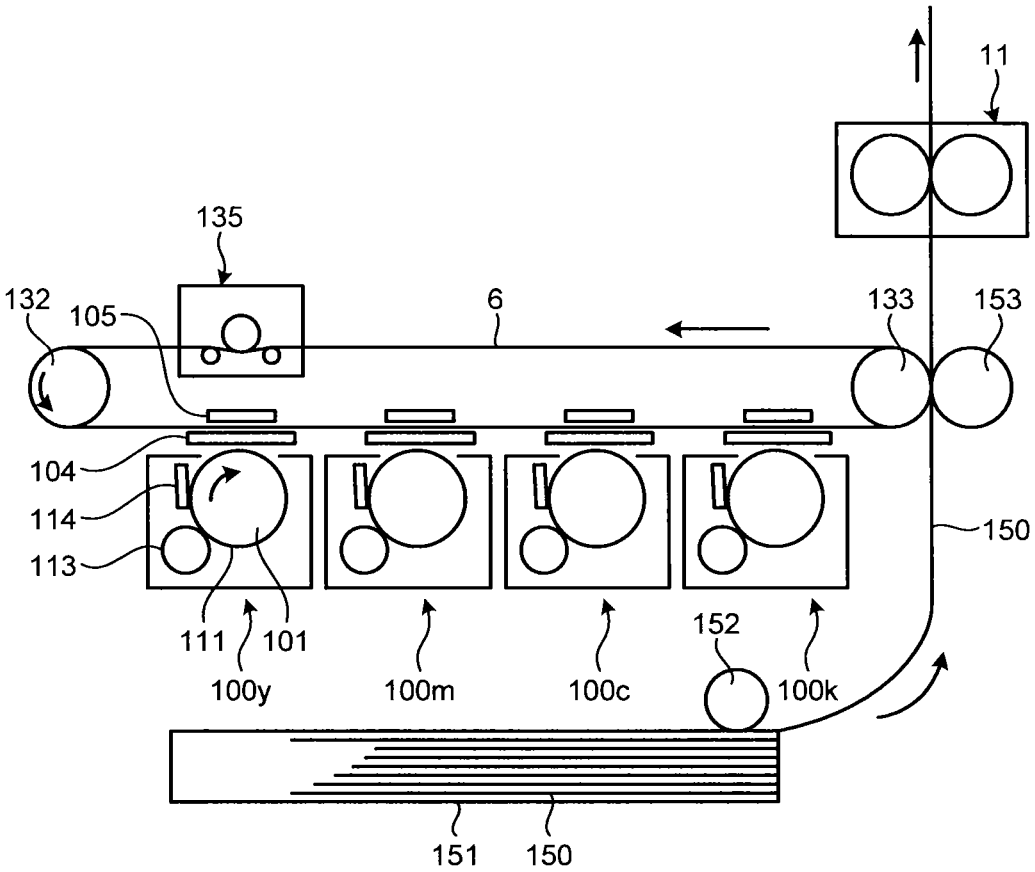
FIG. 6 is a general schematic of a structure of an image forming apparatus according to a first variation of the embodiment.

FIG. 6 is a general schematic of a structure of an image forming apparatus according to a first variation of the embodiment.

In the embodiment, the toner image forming unit is a so-called indirect image forming unit that forms a latent image on a photosensitive element being a latent image carrier, forms a toner image by attaching toner to the latent image, and then transfers the toner image onto the intermediate transfer belt. In the first variation, the toner image forming unit forms a toner image directly on the intermediate transfer belt, by allowing the toner to selectively attach to a dot forming area on the intermediate transfer belt, without any formation of a latent image.

Figure 7:
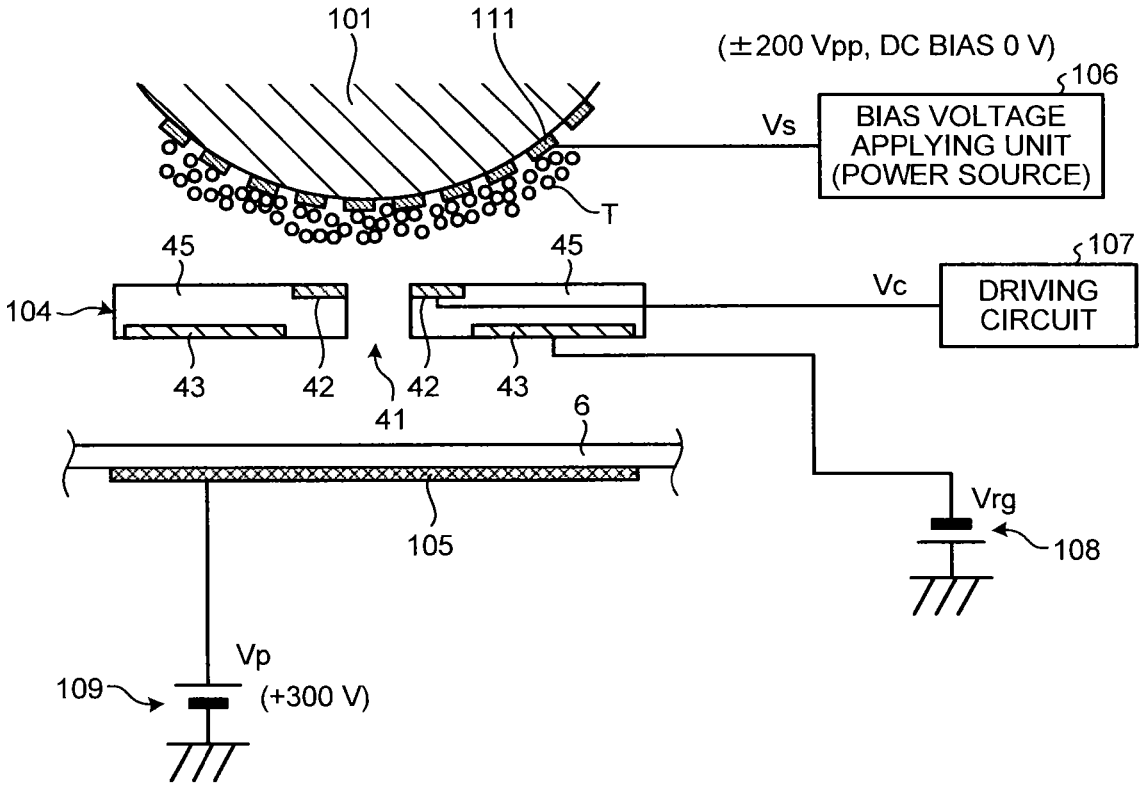
FIG. 7 is a schematic for explaining an example of a structure of a relevant portion of the image forming apparatus according to the first variation.

FIG. 7 is a schematic for explaining an example of a structure of a relevant portion of the image forming apparatus according to the first variation. The image forming apparatus according to the first variation includes a roller-like toner carrier 101 that carries toner T including pressure-phase transition resin in the form of a toner cloud, and a toner control unit 104. The toner control unit 104 is positioned between the toner carrier 101 and the intermediate transfer belt 6 to which the toner T is attached.

Provided on the surface of the toner carrier 101 are a plurality of control electrodes 111 that are arranged at a given pitch along a direction (axial direction in this example) intersecting with a direction in which the toner T is conveyed (in the circumferential direction in this example). To each of these control electrodes 111 arranged on the toner carrier 101, a bias voltage applying unit (power source) 106 applies a pulse voltage (cloud pulse) Vs at a potential that changes over time. For example, applied is a pulse voltage Vs at a frequency from 0.5 kilohertz to 7 kilohertz. Because the electrodes 111 are arranged at a fine pitch, a strong electrical field is generated between the electrodes 111. Therefore, the toner T is released from the surface of the electrodes 111 having a potential repelling the toner T, and the toner T thus released is attracted to the electrodes 111 applied with a potential having a polarity attracting the toner T. By switching the pulse voltage Vs, the toner T is caused to move up and down repeatedly, in a manner corresponding to the pulse frequency, and turned into a toner cloud.

The toner control unit 104 has a plurality of toner pass-through holes (openings) 41 (only one of them is illustrated in FIG. 7) allowing the toner T to pass through and arranged in a plurality of rows. A ring-like control electrode 42 is provided on the periphery of each of the toner pass-through holes 41 on the toner-supplying side (toner carrier side) surface of the toner control unit 104. Common electrodes 43 are provided on a printing-side surface (recording medium side surface) of the toner control unit 104 slightly separated from the toner pass-through holes 41.

Figure 8:
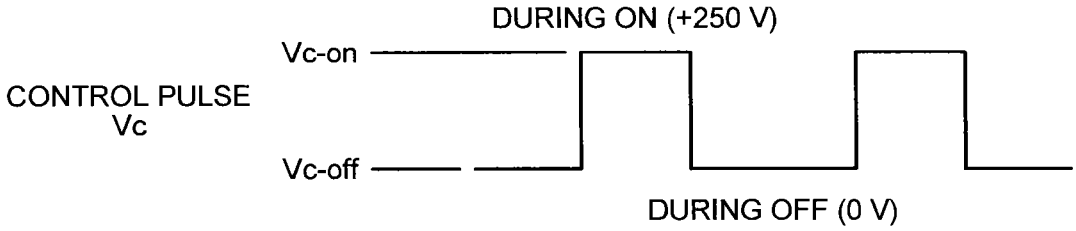
FIG. 8 is a schematic for explaining ON/OFF states of a control pulse.

A driving circuit 107 being a control voltage applying unit (control pulse applying unit) P applies a control pulse Vc illustrated in FIG. 8, for example, to the control electrodes 42 included in the toner control unit 104. At this time, to allow the toner T to pass through the toner pass-through holes 41 (ON state), a voltage Vc-on is applied to the control electrodes 42. By contrast, to prevent the toner T from passing through the toner pass-through holes 41 (OFF state), a voltage Vc-off is applied to the control electrodes 42. The common electrode 43 on the printing side surface is constantly applied with a voltage Vrg from a power source 108 being a voltage applying unit to prevent the electrical fields in a printing side area of the toner control unit 104 from interfering each other.

The control electrodes 42 included in the toner control unit 104 is operable simply by providing the control electrodes 42 on the periphery of each of the toner pass-through holes 41. However, the control electrodes 42 may also be provided on the inner wall of each of the toner pass-through holes 41, or on both of the inner wall of and the toner carrier side periphery of each of the toner pass-through holes 41.

On the rear surface of the intermediate transfer belt 6 on the opposite side of the surface on which the toner is attached, a rear side electrode 105 being a facing electrode unit is arranged in a manner facing and in contact with the rear side. To the rear side electrode 105, a bias power source 109 being a bias voltage applying unit applies a bias voltage Vp for allowing the toner T passed through the toner control unit 104 to attach to the intermediate transfer belt 6.

The electrodes may be configured to be embedded inside of the intermediate transfer belt 6 (configured to provide the facing electrode unit as an internal electrode on the recording medium side). In such a configuration, the bias voltage Vp is applied to the internal electrode in the intermediate transfer belt 6.

A plurality of electrodes 111 are provided on the surface of the toner carrier 101, as a means for turning the toner carried on the surface of the toner carrier 101 into a toner cloud, and a voltage Vs is applied to each of the electrodes 111. Two adjacent electrodes 111 are arranged at a two-phased electrode pitch p allowing a voltage to be applied in directions causing the toner T to be attracted and repelled alternatingly between the electrodes, or at a two-phased electrode pitch allowing a two-phased voltage to be applied to each of the electrode 111 in every two line.

Figure 9A:
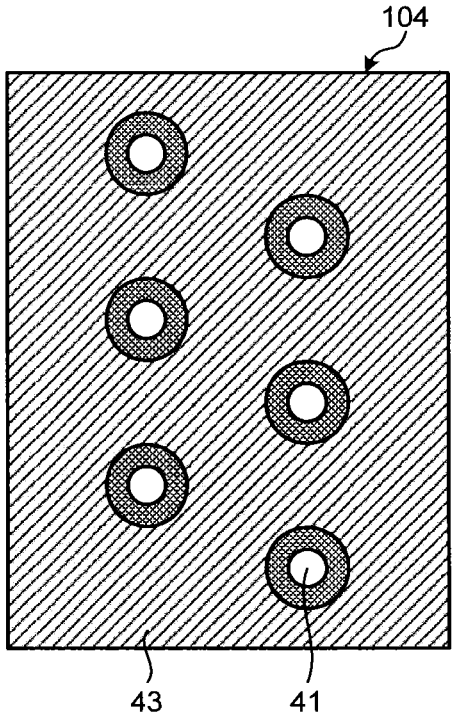
FIG. 9A is a schematic for explaining an example of a printing side surface of a toner control unit seen from the side of the intermediate transfer belt.
Figure 9B:
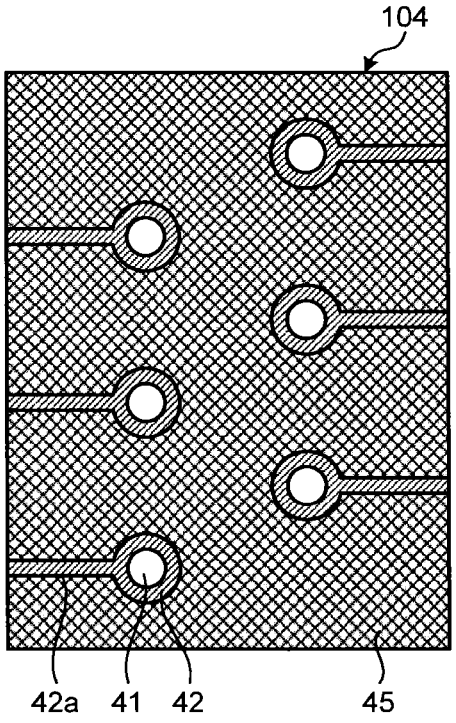
FIG. 9B is a schematic for explaining an example of a toner supply side surface of the toner control unit seen from the side of a toner carrier.

FIG. 9A is a schematic for explaining an example of a printing side surface of the toner control unit 104 seen from the side of the intermediate transfer belt. FIG. 9B is a schematic for explaining an example of a toner supply side surface of the toner control unit 104 seen from the side of the toner carrier. In the example illustrated in FIG. 9B, ring-like control electrodes 42 each of which has a given width (for example, a width of 10 micrometers to 100 micrometers) are provided in a manner surrounding the respective toner pass-through holes 41 on a toner supply side (the side of the toner carrier 101) surface of an insulating substrate (base member) 45. The size of each of the toner pass-through holes 41 is determined by a dot diameter of an image to be formed, and has a diameter from ϕ50 micrometers to ϕ200 micrometers, for example.

A lead pattern 42*a* connected to a driver circuit (driving circuit) for controlling ON and OFF of passing of the toner T is provided to each of the control electrodes 42 in the toner control unit 104. The common electrode 43 is arranged on the printed surface side of the toner control unit 104 excluding the periphery of each of the toner pass-through holes 41. The common electrode 43 is applied with a direct current (DC) potential so that the common electrode 43 is not mutually influenced by an adjacent electrical field regardless of which voltage of Vc-on or Vc-off is applied to the control electrodes 42. In other words, because the electric force between the bias potential of the transfer sheet and the toner supply side can be generated as independent electric force lines each corresponding to each of the toner pass-through holes, the electric force lines are prevented from interfering with each other (from being affected by the state of the other toner pass-through holes) in the case of multi-driving (driving causing the toner to be released from a plurality of nozzle toner pass-through holes).

The toner control unit 104 having such a structure can be manufactured in the manner to be described below, as an example. From the viewpoints of costs and a manufacturing process, a resin film (e.g., polyimide, polyethylene terephthalate (PET), polyethylene naphthalate (PEN), or polyethersulfone (PES)) is used as the base member 45 being an insulating member. The thickness of the resin film is preferably 30 micrometers to 100 micrometers. On the front and the rear surfaces of the resin film, an aluminum (Al) vapor-deposited film is formed at a thickness from 0.2 micrometer to 1 micrometer. As a photolithography process of the front surface (frontal surface) of the resin film on which the Al vapor-deposited film is formed, photoresist is applied to the front surface using a spinner. The resin film is then pre-baked, exposed with a mask, developed, and then heated to harden the photoresist. Similarly, the printed surface side patterns are formed on the rear surface of the resin film on which the Al vapor-deposited film is formed, in the same photolithography process as that described above. Al patterns are then formed on the rear surface using Al etchant. The pass-through holes being the toner pass-through holes 41 are formed after the Al patterns are formed. As a process of forming the pass-through holes, a mechanical process using a press, a process of applying an excimer laser to the pattern thus formed, or a dry etching process such as sputter etching using a metal mask may be used. By adopting these processes, the pass-through holes can be processed highly precisely, without any positional deviation.

In the image forming apparatus according to the first variation including the toner image forming unit having the toner carrier 101 and the toner control unit 104 with the structures described above, by applying two-phase pulse voltage having a phase shifted by 180 degrees to the electrodes 111 on the toner carrier 101, the toner T is released to turn into a toner cloud on the toner carrier 101. The toner T is then conveyed by a rotation of the toner carrier 101. The printing bias voltage Vp is applied to the rear side electrode 105 on the intermediate transfer belt 6. In this condition, the voltage Vrg is applied to the common electrode 43 in the toner control unit 104. To allow the toner T to pass through the toner pass-through holes 41 (ON state), the voltage Vc-on for the ON state illustrated in FIG. 8 is applied to the control electrodes 42. To prevent the toner T from passing through the toner pass-through holes 41 (OFF state), the voltage Vc-off for the OFF state illustrated in FIG. 8 is applied. At this time, by setting the voltages applied to the respective electrodes 111, 105, 42, and 43 in a manner to be described later, when the control electrodes 42 is applied with Vc-on allowing the toner T on the toner carrier 101 to pass through the toner control unit 104 toward the intermediate transfer belt 6, the electric force lines 110 are generated from the intermediate transfer belt 6 toward the toner supply side (see FIG. 10A). The toner cloud on the toner carrier 101 is carried by the electrical field generated by the electric force lines 10, passed through the toner pass-through holes 41 on the toner control unit 104, and lands on the intermediate transfer belt 6. Therefore, by controlling ON/OFF (opening and closing) of each the toner pass-through holes 41 in the toner control unit 104 based on an image to be formed, it is possible to form the toner image directly on the intermediate transfer belt 6.

Figure 10A:
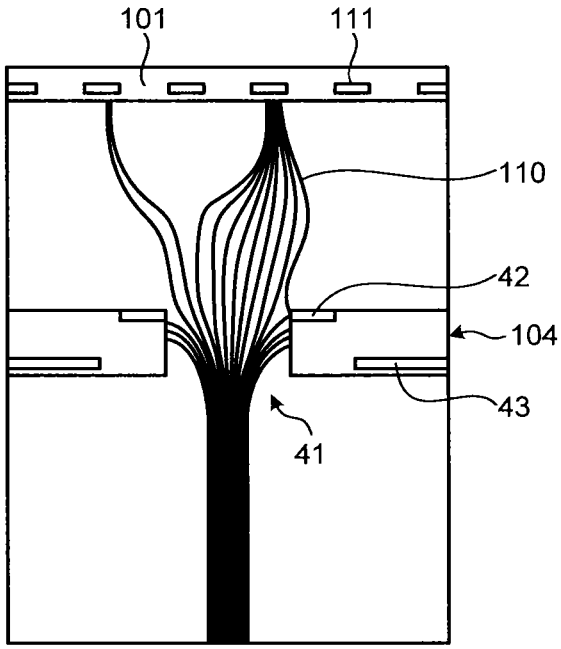
FIGS. 10A and 10B are schematics for explaining electric force lines passing through toner pass-through holes based on a simulation result of an electrical field intensity distribution in a two-dimensional cross section of the toner carrier, the toner control unit, and the intermediate transfer belt.
Figure 10B:
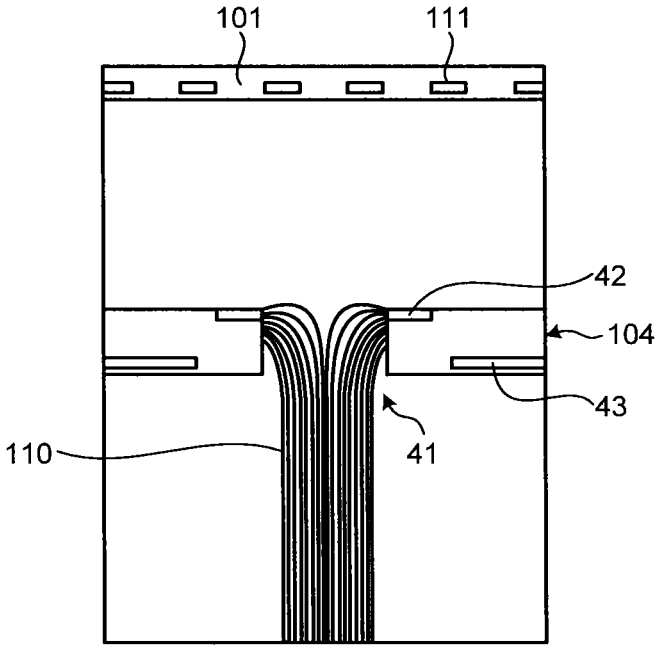

FIGS. 10A and 10B are schematics for explaining electric force lines passing through the toner pass-through holes based on a simulation result of an electrical field intensity distribution in a two-dimensional cross section of the toner carrier 101, the toner control unit 104, and the intermediate transfer belt 6, assuming that the pulse voltage Vs is applied to the electrodes 111 on the toner carrier 101, the bias voltage Vp is applied to the rear side electrode 105 on the intermediate transfer belt 6, and the control pulse voltage Vc is applied to the control electrodes 42 in the toner control unit 104.

The pulse voltage (with a potential varying over time) Vs is applied to the electrodes 111 on the toner carrier 101. The crest value of the bias voltage Vp is set accordingly to the electrode pitch, toner used, and the like. According to results of general experiments, the toner is released when the crest value of the bias voltage Vp is set within a range from ±60 volts peak-to-peak to ±300 volts peak-to-peak.

Applied in the example of the simulation illustrated in FIGS. 10A and 10B is a voltage with ±200 volts peak-to-peak and 0-volt DC voltage component. The distance d between the toner carrier 101 and the toner control unit 104 is 0.2 millimeter. In this example, the diameter of each of the toner pass-through holes 41 in the toner control unit 104 is ϕ120 micrometers. The width of each of the ring-like control electrodes 42 in a direction toward the center of the hole is 50 micrometers. The distance between the common electrode 43 and the hole is 50 micrometers. The voltage applied to the common electrode 43 of the toner control unit 104 is 0 volts. When the toner T is allowed to pass through the toner pass-through holes 41 (ON state), the control pulse voltage Vc-on of +250 volts is applied to the control electrodes 42 in the toner control unit 104. The voltage Vc-off used in the blocking state (not allowing the toner T to pass through) other than when the toner is allowed to pass through is set to 0 volts.

The bias voltage Vp applied to the rear side electrode 105 on the intermediate transfer belt 6 may be a DC voltage from +200 volts to +1500 volts, for example, although it depends on the distance between the toner control unit 104 and the intermediate transfer belt 6. In the example illustrated in FIGS. 10A and 10B, the distance between the toner control unit 104 and the intermediate transfer belt 6 is 0.3 millimeter, and a DC voltage of +800 volts is applied to the rear side electrode 105 so that a potential gradient for attracting negatively charged toner to the surface of the intermediate transfer belt 6 is generated.

By setting the relationship of the potentials applied to the electrodes 111, 42, 43, and 105 in the manner described above, when the negatively charged toner is allowed to pass through the toner pass-through holes 41 (ON state) (FIG. 10A), for example, electric force lines to be explained are generated. In other words, among the electric force lines emitted from the electrode 105 on the intermediate transfer belt having a highest potential in the positive side, many of the electric force lines passing through the toner pass-through holes 41 in the toner control unit 104 enter electrodes with the lowest potential, that is, the electrodes 111 applied with the −200 volts on the toner carrier, after passing through the toner pass-through holes 41.

When the toner T is allowed to pass through the toner pass-through holes 41 (during the ON state), as illustrated in FIG. 10A, the electric force lines 110 from the electrode 105 on the intermediate transfer belt and passing through the toner pass-through holes 41 enters the two electrodes 42 having the lowest potential at −200 volts. Therefore, negatively charged toner on the toner carrier 101 in the form of a toner cloud or the toner near the carrier electrodes at −200 volts are allowed to pass through the toner pass-through holes 41 along the electric force lines 110, so that the toner T can be released toward the surface of the intermediate transfer belt 6.

By contrast, during the blocking state (OFF state) in which the toner T is prevented from passing through the toner pass-through holes 41 (FIG. 4B), −200 volts are applied to the control electrodes 42. Despite the lower potential of the electrodes 111 on the toner carrier 101 is at −200 volts as well, all of the electric force lines from the electrode 105 on the intermediate transfer belt enter the control electrodes 42 that are provided near the electrode 105. Therefore, the toner on the surface of the toner carrier 101 and the toner supplying area above the surface of the toner carrier 101 is prevented from being released toward the electrode 105 on the intermediate transfer belt. The voltage applied to the control electrodes 42 during the blocking state (OFF state) does not need to be at the same potential as the lower potential of the electrodes 111 on the toner carrier 101. As long as a condition does not allow the electric force lines passing through the toner pass-through holes 41 to reach the surface of the toner carrier 101, the toner T can be prevented from passing through the toner pass-through holes 41 (the control electrodes 42 can be switched to the OFF state).

As illustrated in FIG. 6 mentioned earlier, in the image forming apparatus according to the first variation, the intermediate transfer belt 6 is stretched across two rollers 132 and 133 and is moved circumferentially in the direction illustrated by the arrow. On the rear (inner) side of the intermediate transfer belt 6, the rear side electrode 105 is arranged correspondingly to each of the toner image forming units. A cleaning unit 135 for removing residual toner on the intermediate transfer belt 6 after the toner is transferred onto the transfer sheet is also provided.

Each toner image forming unit 100 includes a rotating toner supplying roller 113 that supplies toner to the toner carrier 101, and a blade 114 that regulates the amount of toner on the toner carrier 101, in addition to the toner carrier 101, the toner control unit 104, and the like.

In the toner image forming unit 100, toner is supplied to the toner carrier 101 from the toner supplying roller 113, and the toner is triboelectrically charged by a friction between the toner on the toner supplying roller 113 and the toner carrier 101.

The blade 114 provided downstream of the toner supplying roller 113 keeps the amount of toner on the surface of the toner carrier 101 to a thin layer, and stabilizes the amount of toner charge.

The toner carried by the toner carrier 101 is released onto the intermediate transfer belt 6 by causing the toner control unit 104 to control ON/OFF based on an image, and a color toner image is formed on the intermediate transfer belt 6.

A paper feeding unit 151 storing therein a transfer sheets 150 is positioned below the toner image forming units 100. A pickup roller (paper feeding roller) 152 feeds a transfer sheet 150 from the paper feeding unit 151. On the transfer sheet 150 fed from the paper feeding unit 151, a toner image on the intermediate transfer belt 6 is transferred by a transfer roller 153 arranged facing the roller 132 across which the intermediate transfer belt 6 is stretched.

In the variation as well, the transfer roller 153 is pressed against the intermediate transfer belt so that the pressure applied to the toner in a region where the toner on the intermediate transfer belt 6 is brought into contact with the transfer sheet 150 is equal to or higher than the level at which the toner is plastically deformed and equal to or lower than the level at which the toner is transformed into a film, so that the toner image on the intermediate transfer belt is transformed into a semi-film. When a bias voltage having a positive polarity (positive bias) is applied to the transfer roller 153 provided on the rear side of the transfer sheet 150, the toner image having transformed into a semi-film is transferred from the intermediate transfer belt 6 onto the surface of the transfer sheet 150. Therefore, in the first variation as well, toner scattering and incomplete images can be suppressed when a toner image is transferred onto a transfer sheet. Furthermore, a load of driving the intermediate transfer belt 6 can be reduced compared when a toner image on the intermediate transfer belt is transformed into a film. Therefore, driving unevenness can be reduced. In this manner, a registration error in an image can be suppressed. Furthermore, the intermediate transfer belt 6 can be prevented from being damaged. Furthermore, in the first variation, the toner image on the intermediate transfer belt 6 is transformed into a semi-film in the transfer unit. Alternatively, means for pressing and transforming the toner image on toner image on the intermediate transfer belt 6 into a semi-film may be provided between the Bk-color toner image forming unit 100K and the transfer unit.

The transfer sheet 150 on which the toner image is transferred is carried to the fixing unit 11. After the toner is fixed on the transfer sheet 150 by the fixing unit 11, the transfer sheet 150 is discharged.

As mentioned earlier, the residual toner on the intermediate transfer belt 6 is cleaned by the cleaning unit 135 being an intermediate transfer body cleaning unit, and a next image formation is performed.

As mentioned earlier, the image forming apparatus according to the first variation adopts an intermediate transfer recording technique in which a four color toner image is formed on the intermediate transfer belt 6, and the four color toner image on the intermediate transfer belt 6 is transferred onto the transfer sheet 150 supplied from the paper feeding unit 151.

In the intermediate transfer recording technique, it is easy to ensure the precision at which the distance between the printing surface (also referred to as a "surface on which the toner lands" or an "image forming surface") and the toner control unit 104 is kept constant. Therefore, high quality images can be formed at a lower toner releasing speed.

In addition, in the case of an intermediate transfer recording technique, a smooth printing surface without electric charge accumulation and without any potential variation can be achieved by adjusting volume resistivity. In case of an image forming apparatus that directly prints on a transfer sheet by turning ON/OFF of allowing the toner cloud to pass through, because the image forming apparatus is highly sensitive to a potential, an image variation could occur more easily in response to a variation in the bias potential in the printing surface. However, a structure using the intermediate transfer recording technique can achieve high quality color images highly reliably.

An exemplary structure of the toner carrier 101 that may be used in the image forming apparatus according to the first variation will now be explained.

Figure 11A:
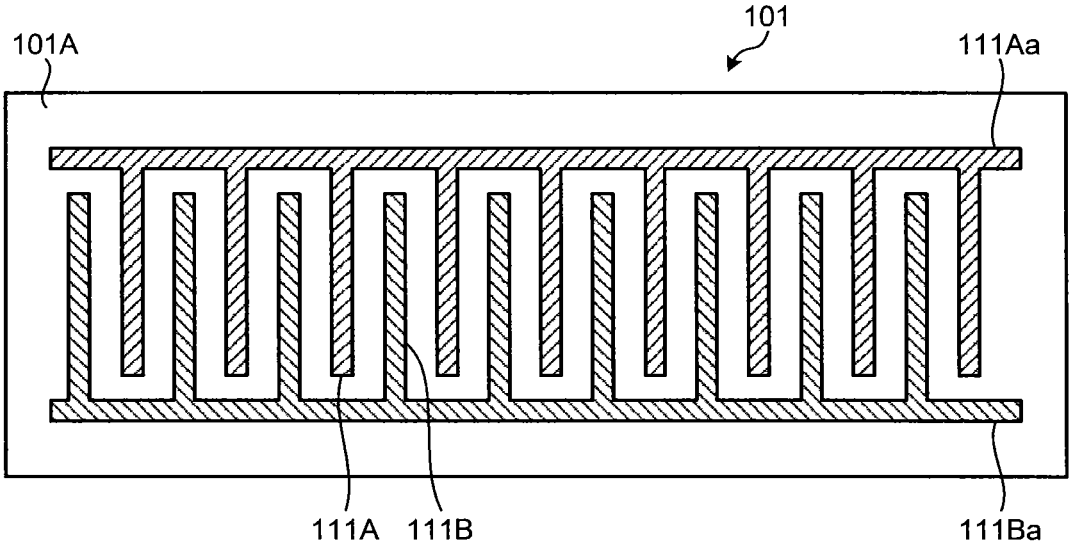
FIG. 11A is an explanatory plan view schematically illustrating an exemplary structure of the toner carrier opened flat.
Figure 11B:
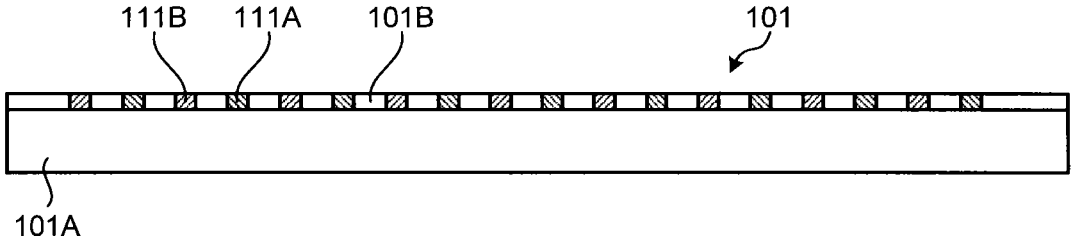
FIG. 11B is an explanatory cross-sectional view of the toner carrier.
Figure 12:
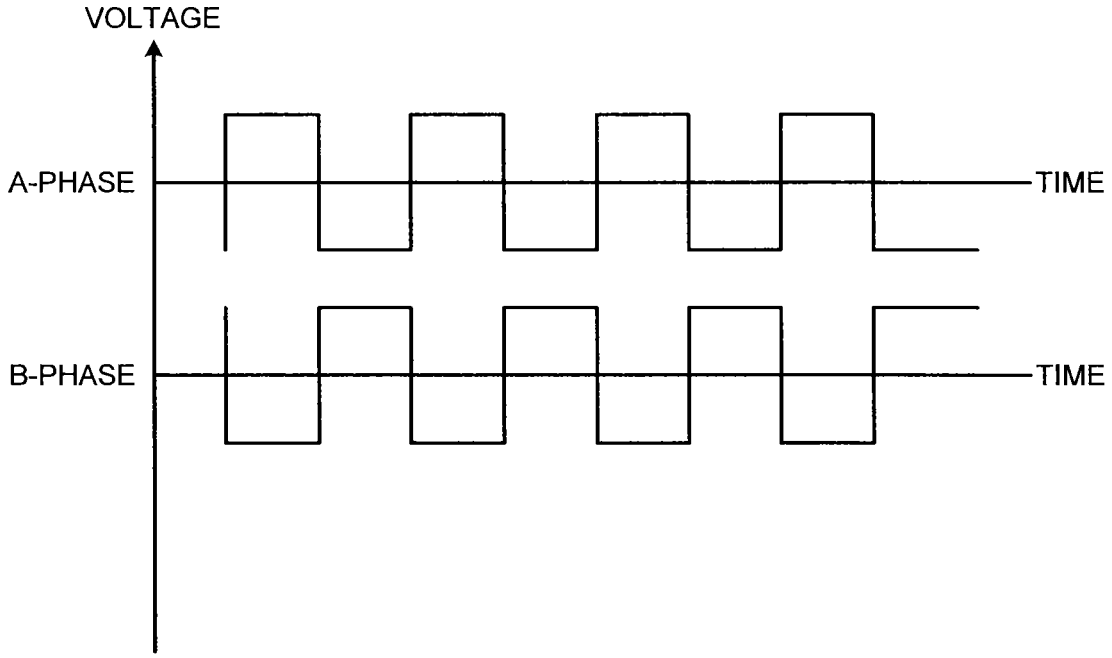
FIG. 12 is a schematic for explaining an example of a pulse voltage applied to electrodes on the toner carrier.

FIG. 11A is an explanatory plan view schematically illustrating an exemplary structure of the toner carrier 101 opened flat. FIG. 11B is an explanatory cross-sectional view of the toner carrier. In the example illustrated, a plurality of electrodes are provided on the surface of the toner carrier 101, and two pairs of the electrodes each pair having one electrode therebetween are shared to realize two-phase electrodes. To each of the two-phase electrodes in each of the two pairs, a two-phase pulse having a phase shifted by 180 degrees is applied (for example, see the A phase pulse and the B phase pulse illustrated in FIG. 12), to generate a two-phase electrical field in which attraction and repellent are repeated between adjacent electrodes.

In FIG. 11, the toner carrier 101 includes an insulating substrate 101A on the surface of which A electrodes (first electrodes) 111A and B-phase electrodes (second electrodes) 111B as a plurality of the electrodes 111 are provided, and a surface protection layer 101B provided on top of the electrodes 111. Each of the electrodes 111A and 111B are formed in a pectinate shape, and arranged at a fine pitch along a direction in which the toner is conveyed and in parallel with a direction perpendicular to the direction in which the toner is conveyed. Common bus lines 111Aa and 111Ba are provided on both side of a direction perpendicular to the toner conveying direction, respectively. Each of the bus lines 111Aa and 111Ba are connected to an external two-phase pulse generating circuit not illustrated.

Applied to the electrodes 111A and 111B is a pulse voltage at a frequency from 0.5 kilohertz to 7 kilohertz and including a DC voltage as a bias, for example. The crest value of the pulse voltage is within a range from ±60 volts to ±300 volts, for example, and determined based on the width of the electrodes, the pitch between the electrodes, and the type of toner used. By applying the pulse voltage, a two-phase electrical field is generated between the respective electrode 111A and electrode 111B, and the toner is caused to be attracted and repelled repeatedly, as the direction of the electrical field between the adjacent electrodes is switched. By being attracted to and repelled by these electrodes, the toner is caused to reciprocate between the electrode 111A and the electrode 111B. The entire toner carrier 101 is rotated to move the surface of the toner carrier 101 in a direction to which toner is carried.

The toner carrier 101 illustrated in FIG. 11 is configured to include a plurality of electrodes 111A and 111B each extending in a direction perpendicular to the toner conveying direction and arranged at a given pitch on the surface of the toner carrier 101, to apply a pulse voltage alternating in directions in which the toner is attracted and in which the toner is repelled to each of the electrodes 111A and 111B, and is configured to drive the toner carrier 101 in rotation in a given direction. In this manner, by configuring the toner carrier 101 so as to carry the toner and to generate a toner cloud, the toner can be carried stably regardless of the charging quality of the toner when the toner is conveyed on the surface of the toner carrier 101. Therefore, a highly reliable image forming apparatus can be achieved as the entire apparatus.

Figure 13A:
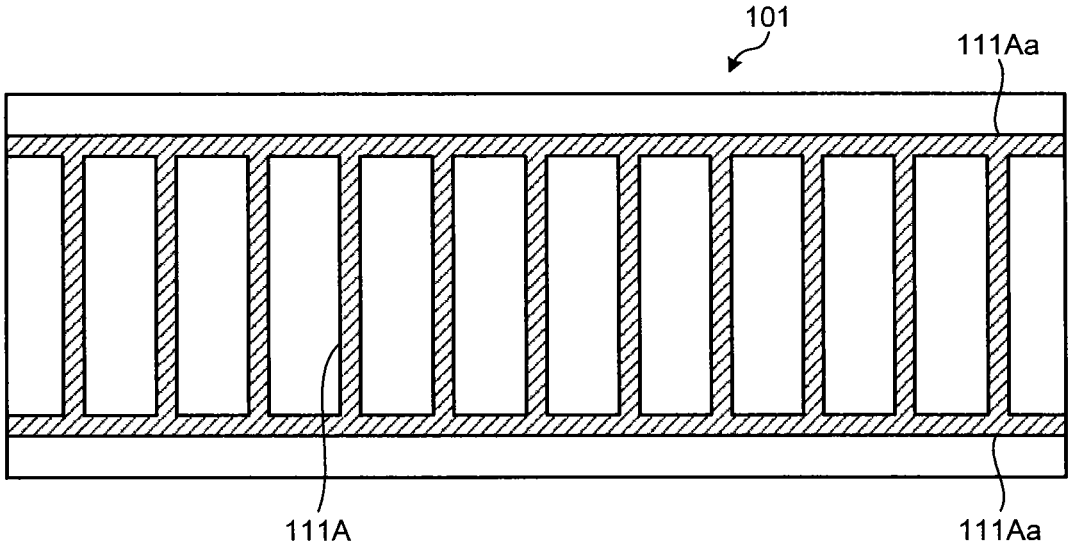
FIG. 13A is an explanatory plan view schematically illustrating another exemplary structure of the toner carrier opened flat.
Figure 13B:
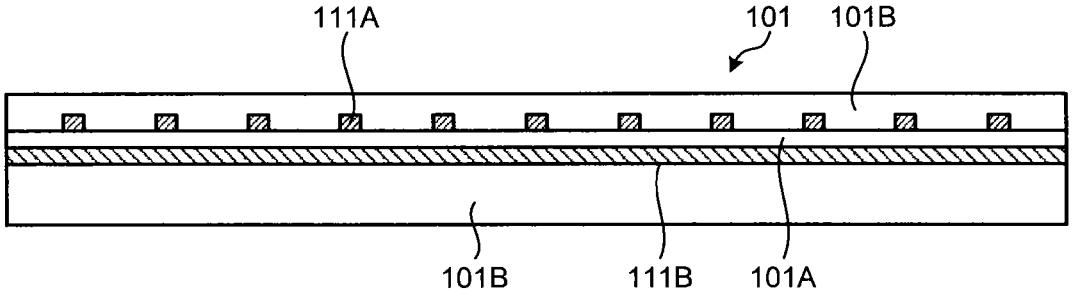
FIG. 13B is an explanatory cross-sectional view of the toner carrier.

FIG. 13A is an explanatory plan view schematically illustrating another exemplary structure of the toner carrier 101 opened flat. FIG. 13B is an explanatory cross-sectional view of the toner carrier 101. In the example illustrated in FIGS. 13A and 13B, a plurality of electrodes are provided on the surface of the toner carrier, and all of the electrodes on the front layer are shared. In this exemplary toner carrier, the two-phase pulse having a phase shifted by 180 degrees (see FIG. 12) is applied between each of the electrodes on a front layer and a conductive base member electrode provided on a bottom layer with an insulating layer therebetween. The toner is attracted and repelled alternatingly by electrical fields generated between the electrodes on the front layer and the conductive base member electrode on the bottom layer. In FIGS. 13A and 13B, the same elements as those in FIGS. 11A and 11B are given the same reference numerals, and explanations thereof are omitted herein.

In FIG. 13B, the toner carrier 101 is provided with A-phase electrodes 111A on the surface of the insulating substrate 101A arranged internally as a plurality of electrodes and a flat conductive base member (B-phase electrode) 111B arranged on the bottom surface of the insulating substrate. Protective layers 101B and 101B are provided on the surfaces of the electrodes 111A and the electrode 111B, respectively. The electrodes 111A on the front surface is arranged at a fine pitch in the toner conveying direction, and are in parallel with each other in the direction perpendicular to the toner conveying direction. A bus line 111Aa is arranged on each end of the direction perpendicular to the toner conveying direction. The bus lines 111Aa included in electrodes 111A and the electrode 111B on the bottom surface of the insulating substrate 101A are connected an external two-phase pulse generating circuit not illustrated.

The two-phase pulse voltage applied to the electrodes 111A and 111B is a pulse voltage at a frequency from 0.5 kilohertz to 7 kilohertz, and including a DC voltage as a bias, for example. The crest value of pulse voltage is within a range from ±60 volts to ±300 volts, for example, and is determined based on the electrode width, the electrode pitch, and the type of toner used, for example. A structure for applying the pulse voltage is the same as that illustrated in FIG. 7. When the pulse voltage is applied, the toner is caused to reciprocate repeatedly between (in the space between) the electrodes 111A and 111A on the front layer, as the two-phase pulse is switched. The entire toner carrier 101 is rotated to move the surface of the toner carrier 101 in the toner conveying direction.

In the specific structure of the toner carrier 101 illustrated in FIGS. 13A and 13B, as the insulating substrate 101A being a base substrate, a base member made of an insulating material such as resin or ceramic, or a base member made of a conductive material such as aluminum on which an insulating film made of $SiO_2$ is formed, or a base member made of a flexibly deformable material such as a polyimide film may be used, for example.

The electrodes 111 may be formed from a layer of a conductive material such as Al or Ni—Cr on the base substrate at a thickness from 0.1 micrometer to 1 micrometer, formed into a given pattern of electrodes using a photolithography technology. Alternatively, the electrodes 111 may be formed by laminating copper on the base substrate, or by forming the pattern by plating, and the pattern may be achieved through a photolithographic process. The bottom layer conductive base member electrode 111B may be made of a conductive material such as Al or Ni—Cr.

The surface protection layer 101B may be formed by forming a layer of $SiO_2$, $TiO_2$, TiN, or $Ta_2O_5$ at a thickness from 0.5 micrometer to 2 micrometers through vapor deposition, or by printing an organic material such as polycarbonate, polyimide, or methyl methacrylate at a thickness from 2 micrometers to 10 micrometers into a thin layer, and heating to harden.

In the toner carrier 101 having such a structure, because the releasing electrical field is generated by causing the driving circuit 107 to apply the pulse for releasing the toner, the charged toner on the toner carrier 101 is conveyed along a direction of the traveling wave reciprocating up and down by being attracted or repelled by the electrical field.

Figure 14:
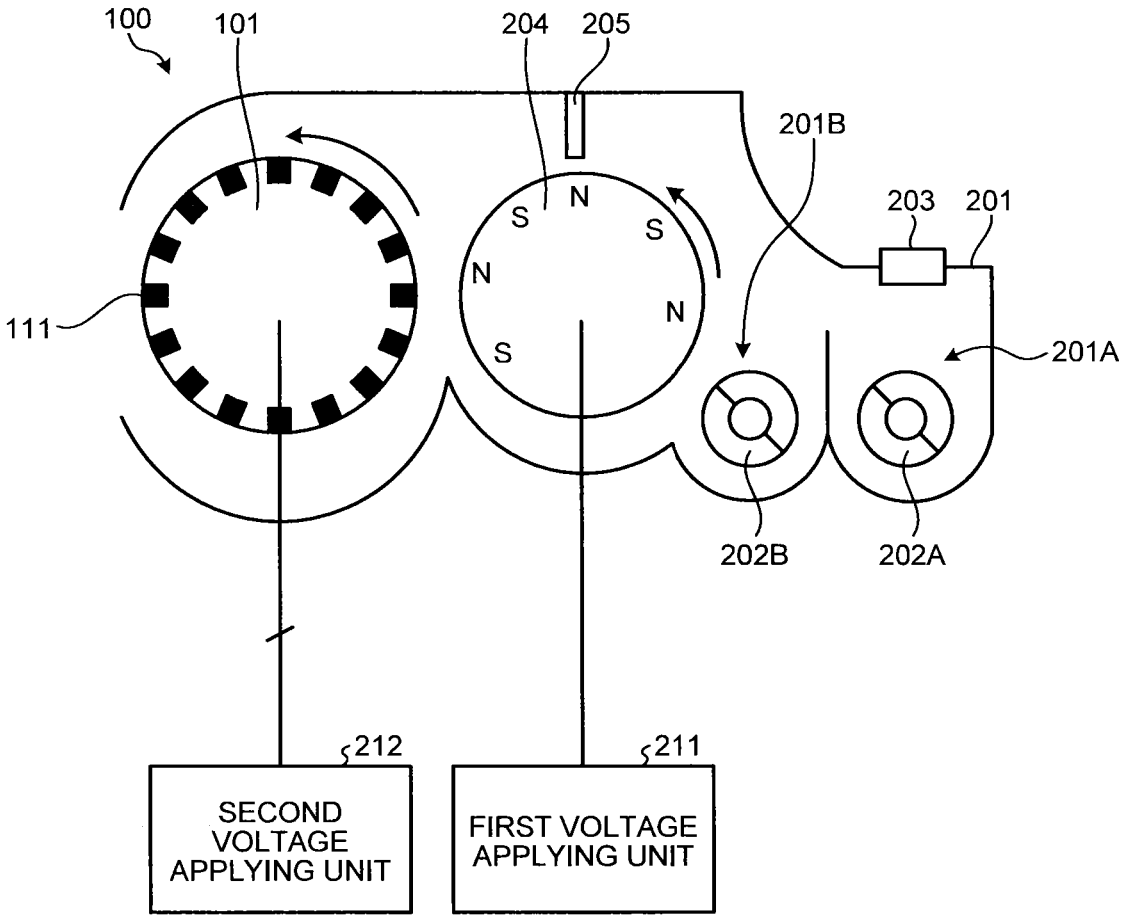
FIG. 14 is a schematic generally illustrating another exemplary structure of a toner image forming unit.

FIG. 14 is a schematic generally illustrating another exemplary structure of the toner image forming unit 100 in the image forming apparatus according to the first variation. Used in this exemplary structure is a two-component recording agent containing magnetic carrier and non-magnetic toner. A recording agent housing 201 is divided into two chambers 201A and 201B connected to each other by a recording agent passage (not illustrated) provided on both ends of the toner image forming unit 100. A two-component recording agent is stored in the recording agent housing 201, and is conveyed through the recording agent housing 201 by being stirred by stirring conveying screws 202A and 202B respectively provided in the chambers 201A and 201B. The chamber 201A in the recording agent housing 201 has a toner supplying opening 203, and the toner is supplied from a toner housing not illustrated into the recording agent housing 201 via the toner supplying opening 203.

In the recording agent housing 201, a toner concentration sensor not illustrated that detects the magnetic permeability of the recording agent is installed, and detects the concentration of the recording agent. When the toner concentration in the recording agent housing 201 decreases, the toner is supplied into the recording agent housing 201 via the toner supplying opening 203. A magnetic brush roller 204 being a toner supplying roller is positioned facing the stirring conveying screw 202B. A magnet is fixed inside of the magnetic brush roller 204, and recording agent in the recording agent housing 201 is lifted to the surface of the magnetic brush roller 204 by a rotation and the magnetic force of the magnetic brush roller 204. A recording agent layer regulating member 205 is provided at a position upstream of where the recording agent is lifted in a rotating direction of the magnetic brush roller 204, in a manner facing the magnetic brush roller 204. The thickness of the recording agent lifted at the lifting position is regulated by the recording agent layer regulating member 205 to a recording agent layer thickness having a certain amount of the recording agent.

The recording agent passed through the recording agent layer regulating member 205 is carried to a position facing the toner carrier 101 as the magnetic brush roller 204 is rotated. A supplying bias is applied to the magnetic brush roller 204 from a first voltage applying unit 211.

A second voltage applying unit 212 applies the voltage explained above illustrated in FIG. 12 to the electrodes 111 on the toner carrier 101.

At the position facing the magnetic brush roller 204, an electrical field is generated between the toner carrier 101 and the magnetic brush roller 204 by the voltages applied by the first voltage applying unit 211 and the second voltage applying unit 212. The toner receiving the electrostatic force from the electrical field is separated from the carrier, and moved to the surface of the toner carrier 101.

The toner reaching the surface of the toner carrier 101 is turned into a toner cloud by the electrical field generated by the voltage applied to the electrodes 111 by the second voltage applying unit 212. The toner cloud is then carried by the rotation of the toner carrier 101, or by the electrical field of the traveling wave on the toner carrier 101. The toner carried to a position facing the toner control unit 104 is selectively released toward a recording medium by the control electrical field generated by ON/OFF controlling of the control electrodes 42 allowing the toner to pass through. In this manner, the dot printing the toner is controlled.

Figure 15:
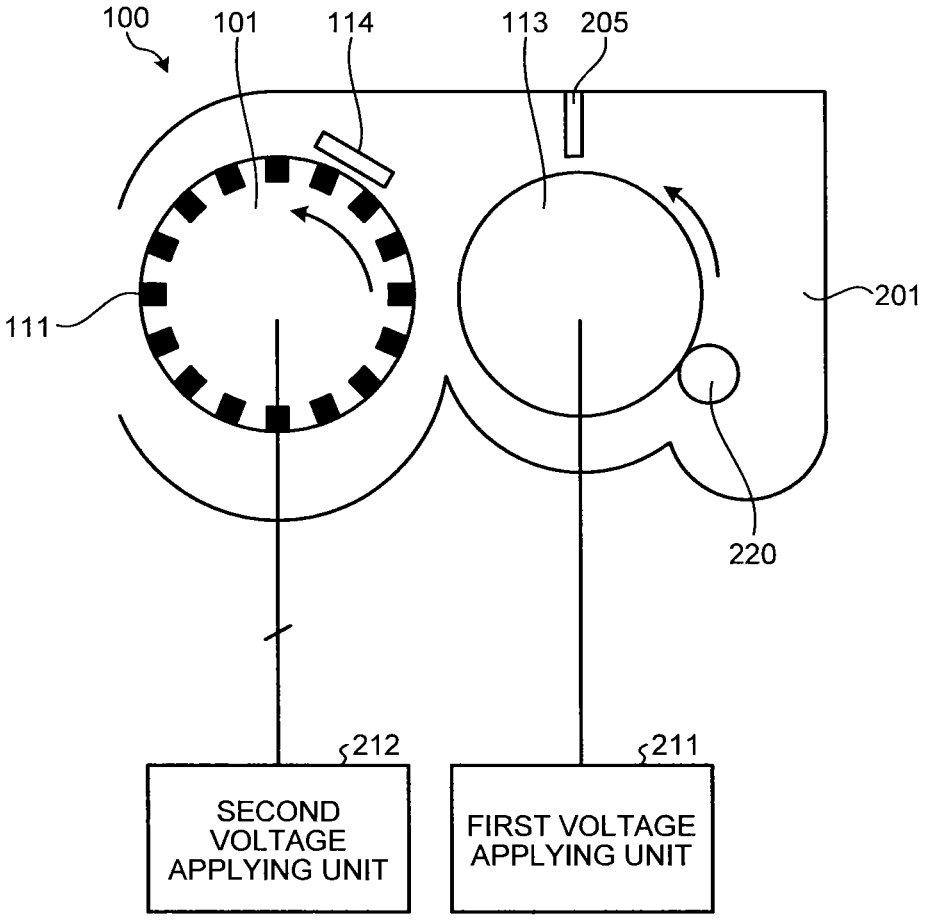
FIG. 15 is a schematic generally illustrating still another exemplary structure of the toner image forming unit.

FIG. 15 is a schematic generally illustrating still another exemplary structure of the toner image forming unit. The toner image forming unit illustrated in FIG. 15 represents an example in which a single component recording agent containing only non-magnetic toner is used. The toner is stored in the recording agent housing 201, and is triboelectrically charged with the toner supplying roller 113 by a roller charging unit 220, and is lifted to the toner supplying roller 113 by the electrostatic force. The toner on the toner supplying roller 113 is turned into a thin layer by the recording agent layer regulating member (blade) 114, and is conveyed to a position facing the toner carrier 101, as the toner supplying roller 113 is rotated. At this time, the supplying bias is applied by a first voltage applying unit 221 to the toner supplying roller 113. A voltage from the second voltage applying unit 212 is applied to the electrodes 111 on the toner carrier 101. Therefore, at the position facing the toner carrier 101, an electrical field is generated between the toner carrier 101 and the toner supplying roller 113 by the voltages applied by the first voltage applying unit 211 and the second voltage applying unit 212, and the toner receiving the electrostatic force from the electrical field is separated from the toner supplying roller 113, and moved to the surface of the toner carrier 101.

Similarly to the exemplary structure mentioned earlier in FIG. 14, the toner reaching the surface of the toner carrier 101 is turned into a toner cloud by the electrical field generated by the voltage applied to the electrodes 111 from the second voltage applying unit 222. The toner cloud is then carried by the rotation of the toner carrier 101, or by the electrical field of the traveling wave on the toner carrier 101.

The toner conveyed to a position facing the toner control unit 104 is selectively released toward the recording medium by the electrical field of the control electrodes 42 controlling ON/OFF of passing the toner. In this manner, dot printing of the toner is controlled.

The toner having not contributed to printing in each of the toner image forming units 100 is further conveyed by the toner carrier 101, and is collected from the surface of the toner carrier 101 by a collecting unit not illustrated. The toner thus collected is returned to the recording agent housing 201, and circulated through the toner image forming unit 100.

The toner containing a pressure-phase transition resin used in the image forming apparatus according to the embodiment will now be explained. The pressure-phase transition resin contained in the toner according to the embodiment preferably has a microphase-separated structure, and a block copolymer or a resin having a core-shell structure is more preferable. More preferably, the block copolymer is composed of a hard-segment polymer with a high glass-transition temperature Tg and a soft-segment polymer with a low glass-transition temperature Tg or a low melting point. It is more preferable for the resin having a core-shell structure to have either the core or the shell composed of a hard-segment polymer with a high glass-transition temperature Tg (hereinafter, also referred to as a "hard-segment component phase" as required), and to have the other one of the core and the shell composed of a soft-segment polymer with a low glass-transition temperature Tg or a low melting point (hereinafter, referred to as a "soft-segment component phase" as required).

If a pressure-phase transition resin is used in toner for image formation, toner becomes fluid when the pressure stimulation is applied. Therefore, in an imaging process including a given fixing process, a desired resin fluidity required in the fixing process can be achieved.

As a pressure-phase transition resin having such a structure, for example, a resin polymerized by a polycondensation, or a resin in which ethylene-unsaturated monomers are polymerized by a radical polymerization may be used.

The resin polymerized by a polycondensation can be synthesized using a known method such as those disclosed in "Jyushukugo (Polycondensation)" (Kagakudojin, published in 1971), and "Polyester Jyushi Handbook (Polyester Resin Handbook)" (ed. by Nikkan Kogyo Shimbun, Ltd., published in 1988). Furthermore, the resin polymerized by a polycondensation can be synthesized using transesterification or direct polycondensation, or by combining these methods. The resin polymerized by a polycondensation may preferably be a polyester resin.

As a resin achieved by polymerizing ethylene-unsaturated monomers, a block copolymer may be acquired by a living anionic polymerization, for example. In the case of the core-shell particles, it is possible and preferable to synthesize nano-sized core-shell resin particles composed of core component polymers and shell component polymers and having different glass-transition temperatures, using a method called two-stage feeding in which monomers are supplied incrementally to a polymerization system.

The glass-transition temperature Tg of the hard-segment component phase is preferably from 45 degrees Celsius to 120 degrees Celsius, and more preferably within a range from 50 degrees Celsius to 110 degrees Celsius. The glass-transition temperature Tg of the soft-segment component phase is preferably lower than the glass-transition temperature Tg of the hard-segment component phase by 20 degrees Celsius or more, and more preferably, lower by 30 degrees Celsius or more in order to allow the toner fluidity to appear by a pressure stimulation. At this time, the values of the glass-transition temperature Tg represents values measured at a temperature increase of 10 degrees Celsius per minutes from −80 degrees Celsius to 140 degrees Celsius, using a differential scanning calorimeter (DSC), based on a method specified in ASTM D3418-82.

The block copolymer or the polycondensation polyester resin can be formulated as a resin particle dispersion through existing dispersion methods, in the same manner as the nano-sized core-shell particles, e.g., through shearing emulsification in which the resin particles are dispersed in an aqueous medium by applying various mechanical shearing forces, such as those applied by a rotating shearing homogenizer, a ball mill, a sand mill, and a Dyno-mill having media, and a pressure-discharging disperser (Gaulin Homogenizer, manufactured by Gaulin Inc.). The resin particle dispersion can also be manufactured through phase-transfer emulsification in which a resin is dissolved into an organic solution, and an aqueous medium is added to the solution to let it phase-transfer, or through a method in which the block copolymer or a precursor of the block copolymer (living low molecular mass component or block having a terminated end) is mixed with a small amount of ethylene-unsaturated compound, the mixture is shearing-emulsified or phase-transfer-emulsified, and then a resin particle dispersion of the block copolymer is prepared with miniemulsion polymerization or suspension polymerization. A toner for image formation can be manufactured using the resin dispersion thus acquired, for example, by combining appropriate amounts of a dispersion containing a pigment and a dispersion containing releasing agent, when required, and through emulsion aggregation.

In the method of manufacturing toner for image formation, the toner particle diameter and the particle diameter distribution can be adjusted by aggregating (associating) the resin particles, the releasing agent particles, and other added particles in the dispersion using a known aggregation method that aggregates (associate) these particles.

Specifically, the toner can be acquired by following steps. The resin particle dispersion and the releasing agent particle dispersion are mixed with the pigment particle dispersion or the like, and an aggregation agent is added to induce hetero-aggregation, thereby forming aggregated particles having a toner diameter. The mixed dispersion system is then heated to a temperature equal to or higher than the glass-transition temperature or the melting point of the resin particles to fuse and to sinter the aggregated particles, and the aggregated particles are washed and dried. At this time, by selecting temperature conditions for heating, the toner shape can be controlled from an irregular shape to a spherical shape.

As a polycondensation resin, a non-crystalline polyester resin or a crystalline polyester resin is preferable. A polyester resin can be prepared through polycondensation by direct esterification, transesterification, or the like using polycondensation monomers such as polycarboxylic acid, polyalcohol, or hydroxy carboxylic acid. At the time of polycondensation, it is possible to use polycondensation catalyst as well to promote polycondensation.

The polycarboxylic acid includes aliphatic, alicyclic, and aromatic polycarboxylic acids, and alkyl ester, anhydride, and acid halide of these acids.

The polyalcohol includes polyalcohol, and ester compound of polyalcohol.

The alkyl ester of the polycarboxylic acid is preferably a lower alkyl ester. A "lower alkyl ester" means an alkyl ester having one to eight carbons in alkoxy portion of the ester. Specifically, examples of a lower alkyl ester include methyl ester, ethyl ester, n-propyl ester, isopropyl ester, n-butyl ester, and isobutyl ester.

The polycarboxylic acid is a compound having two or more carboxyl groups in a single molecule. Among some examples of polycarboxylic acid, dicarboxylic acid is a compound having two carboxyl groups in a single molecule, and examples of the dicarboxylic acid include oxalic acid, succinic acid, maleic acid, adipic acid, β-methyladipic acid, azelaic acid, sebacic acid, nonanedicarboxylic acid, decanedioic acid, undecanedioic dicarboxylic acid, dodecenyl succinic acid, dodecanedicarboxylic acid, fumaric acid, citraconic acid, diglycolic acid, cyclohexanedicarboxylic acid, cyclohexane-3,5-diene-1,2-dicarboxylic acid, 2,2-dimethylol butanoic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and dodecenyl succinic acid.

Examples of polycarboxylic acid other than dicarboxylic acid include trimellitic acid, pyromellitic acid, naphthalenetricarboxylic acid, naphthalenetetracarboxylic acid, pyrenetricarboxylic acid, and pyrenetetracarboxylic acid.

These types of polycarboxylic acid may be used in singularity, or a combination of two or more of these types may be used.

Polyalcohol (poriol) is a compound containing two or more hydroxyl groups in a single molecule. Among different types of the polyalcohol, diol is a compound containing two hydroxyl groups in a single molecule, and examples of the diol include ethylene glycol, propylene glycol, butanediol, diethylene glycol, triethylene glycol, hexanediol, cyclohexanediol, octanediol, decanediol, dodecanediol, ethyleneoxide adduct of bisphenol A, propylene oxide adduct of bisphenol A, and bis-phenoxy fluorene (bisphenoxyethanolfluorene).

Examples of poriol other than diol include glycerin, pentaerythritol, hexamethylolmelamine, hexaethylolmelamine, tetramethylolbenzoguanamine, and tetraethylolbenzoguanamine. These types of the polyalcohol (poriol) may be used in singularity, or a combination of two or more of these types may be used.

The ethylene-unsaturated compound is a compound containing at least one ethylene-unsaturated bond, and may be a monomer composed of hydrophilic group and ethylene-unsaturated bond. Preferable examples of the ethylene-unsaturated compound include styrenes such as styrene, parachlorostyrene, and α-methylstyrene; (meta) acrylic acid esters such as acrylic acid methyl, acrylic acid ethyl, acrylic acid propyl, acrylic acid butyl, acrylic acid lauryl, acrylic acid 2-ethylhexyl, methacrylic acid methyl, methacrylic acid ethyl, methacrylic acid propyl, methacrylic acid butyl, methacrylic acid hexyl, methacrylic acid lauryl, and methacrylic acid 2-ethylhexyl; ethylene-unsaturated nitriles such as acrylonitrile and methacrylonitrile; ethylene-unsaturated dicarboxylic acids such as acrylic acid, methacrylic acid, and crotonic acid; vinyl ethers such as vinyl methyl ether and vinyl isobutyl ether; vinyl ketones such as vinyl methyl ketone, vinyl ethyl ketone, and vinyl isopropenyl ketone; and olefins such as isoprene, buten, and butadiene; and β-carboxyethyl acrylate. Homopolymer consisting of these monomers, copolymer in which two or more of these are polymerized, or a mixture of these can be used.

An example of hydrophilic group includes polar group, and examples of the polar group include acidic polar groups such as carboxyl group, sulfo group, and phosphonyl group, basic polar groups such as amino group, and neutral polar groups such as amide group, hydroxy group, cyano group, and formyl group, but is not limited thereto. Among these groups, in the toner according to the embodiment, the acidic polar group is used preferably. When an acidic polar group and a monomer having an ethylene-unsaturated bond are present in a certain area of the resin particle surface, the resin particles can be made more aggregatable so that the resin particles are turned into toner, and sufficient chargeability can be given to the toner. Examples of acidic polar group used preferably are carboxyl group and sulfo group. Examples of monomer having acidic polar groups include α,β-ethylene-unsaturated compound having carboxyl group and α,β-ethylene-unsaturated compound having sulfo group. Examples of the α,β-ethylene-unsaturated compound having carboxyl group include acrylic acid, methacrylic acid, fumaric acid, maleic acid, itaconic acid, cinnamic acid, monomethyl maleate, maleic acid monobutyl ester, and maleic acid monooctyl ester. The monomer may be used in singularity, or a combination of two or more of these monomers may be used.

When a resin having a glass-transition temperature Tg at 40 degrees Celsius or higher is an ethylene-unsaturated compound polymer, a random copolymer is preferable. Furthermore, a resin containing an ethylene-unsaturated compound having a hydrophilic group as a monomer unit is preferable, and the ethylene-unsaturated compound having a hydrophilic group is preferably included by 0.1 mol percent to 10 mol percent in the copolymer ratio. The reason why the copolymer ratio within this range is preferable is because, during the process of manufacturing toner in the aqueous medium, a shell layer can be formed on the toner more easily by using a resin with Tg at 40 degrees Celsius or higher. Ethylene-unsaturated compound polymer with Tg at 40 degrees Celsius or higher or a polycondensation resin such as polyester resin preferably occupy 50 weight percent or less of the totally bound resin included in the toner, and from 5 weight percent to 20 weight percent is more preferable. If the copolymer ratio is within the range specified above, durability of the toner is improved, and stable image characteristics can be acquired.

Examples of pigments that can be used in the toner according to the embodiment include following.

Examples of black pigments include carbon black, copper oxide, manganese dioxide, aniline black, activated carbon, non-magnetic ferrite, and magnetite.

Examples of yellow pigments include chrome yellow, zinc yellow, yellow ferric oxide, cadmium yellow, chrome yellow, hansa yellow, hanza yellow 10G, benzidine yellow G, benzidine yellow GR, threne yellow, quinoline yellow, and permanent yellow NCG. Examples of orange pigments include red chrome yellow, molybdenum orange, permanent orange GTR, pyrazolone orange, vulcan orange, benzidine orange G, indanthrene brilliant orange RK, and indanthrene brilliant orange GK.

Examples of red pigments include red oxide, cadmium red, red lead, mercury sulfide, Watch-Young red, permanent red 4R, lithol red, brilliant carmine 3B, brilliant carmine 6B, Du Pont oil red, pyrazolone red, rhodamine B lake, lake red C, rose bengal, eoxin red, and alizarin lake.

Examples of cyan pigments include iron blue, cobalt blue, alkali blue lake, Victoria blue lake, fast sky blue, indanthrene blue BC, aniline blue, ultramarine blue, calco oil Blue, methylene blue chloride, phthalocyanine blue, phthalocyanine green, and malachite green oxalate. Examples of purple pigments include manganese purple, fast violet B, and methyl violet lake. Examples of green pigments include chrome oxide, chrome green, pigment green, malachite green lake, and final yellow green G.

Examples of white pigments include zinc white, titanium oxide, antimony white, and zinc sulfide.

The pigment is used in singularity, or a mixture of these pigments is used.

Using these pigments, pigment particle dispersion is prepared by applying general dispersion method, such as rotational shearing homogenizer, medium-based disperser such as ball mill, sand mill, and Attritor having media, high-pressure collision disperser, and Dyno-mill. These pigments are further dispersed into an aquatic component using surface active agent having polarity by homogenizer. These pigments may be added all at once with other particle components into mixed solvent, or divided and added in multiple stages.

The pigment is selected from the viewpoints of hue angle, chroma, lightness, weather resistance, transparency through overhead projector transparency, and distribution in the toner. The pigment is added within a range from 4 weight percent to 15 weight percent of the total weight of solid components in the toner. When a magnetic material is to be used as the black pigment, the pigment is added by 12 weight percent to 240 weight percent, unlike other pigments. The pigment is added by such an amount to ensure coloring after the toner is fixed. Furthermore, by adjusting the median diameter of the pigment particles to 100 nanometers to 330 nanometers, transparency in an overhead projector transparency and color are ensured. The median diameter of the pigment particles is measured by a laser diffraction granularity distribution meter (LA-920 manufactured by Horiba, Ltd.).

Specific examples of releasing agents used in the toner according to the embodiment include various types of ester wax, low molecular mass polyolefins such as polyethylene, polypropylene, and polybutene, silicons indicating a softening point when heated, fatty acid amides such as oleic amide, erucamide, ricinoleic acid amide, and octadecanamide, plant waxes such as carnauba wax, rice wax, candelilla wax, Japanese wax, and jojoba oil, animal waxes such as beeswax, mineral and petroleum waxes such as montan wax, ozocerite, ceresine, paraffin wax, micro crystalline wax, Fischer-Tropsch wax, and denatured substances thereof. These types of wax do not dissolve into a solution such as toluene near the room temperature, and even if they do dissolve, the amount is quite small. These types of wax are dispersed into water along with ionic surface active agent and polymer electrolytes such as polymer acid or polymer base, heated to a melting point or higher, and dispersed into particle-like form using a homogenizer capable of applying high shearing force, or a pressure-discharging disperser (Gaulin Homogenizer, manufactured by Gaulin Inc.). In this manner, a dispersion of the particles in the order of sub-micron is prepared. The diameter of the particles in the releasing agent particle dispersion thus acquired can be measured using the laser diffraction granularity distribution meter (LA-920 manufactured by Horiba, Ltd.).

The releasing agent whose specific examples are mentioned above is preferably added in a range from 5 weight percent to 25 weight percent to the total weight of solid components in the toner, in order to ensure detachability in an oil-free fixing system.

When the releasing agent is used, from the viewpoints of ensuring chargeability and durability, it is preferable to add the resin particle dispersion after the resin particles, the pigment particles, and the releasing agent particles are aggregated so that the resin particles are allowed to attach the surfaces of the aggregated particles.

As a magnetic material, specifically, materials that are magnetized in a magnetic field is used. Examples of such magnetic materials include highly magnetic powder such as iron, cobalt, or nickel, or compounds of ferrite, magnetite, or the like. In the embodiment, when the toner is acquired in an aqueous medium, an attention needs to be paid for transferability of the magnetic material into a water phase, and it is preferable to modify the property of the surface of the magnetic material, and to apply a hydrophobizing process or the like in advance.

As a charge control agent, various charge control agents that are in general use can be used, such as dye composed of complex of quarternary ammonium salt compound, nigrosine compound, aluminum, iron, chrome, or the like, or triphenylmethane pigment, but materials that are hard to dissolve into water is preferable from the viewpoint of controlling ionic strength affecting the stability during aggregation and sintering, and of reducing contamination in waste water.

Examples of surface active agents used in polymerization and dispersion of the pigments, preparation and dispersion of the resin particles, dispersion, aggregation, and stabilization of the releasing agent include anion surface active agents such as salt of sulfate ester, salt of sulfonic acid, phosphoric acid ester, or soap based surface active agents, and cation-based surface active agents such as amine salt type and quaternary ammonium salt type surface active agents. It is also effective to use non-ionic surface active agents such as polyethyleneglycol, alkylphenol ethylene oxide adduct, or polyalcohol based surface active agents as well. As means for dispersing, general means such as rotating shearing homogenizer, or ball mill, sand mill, and Dyno-mill having media is used.

An specific example of the toner containing a pressure-phase transition resin and a method of producing the toner will now be explained more in detail.

Measuring Molecular Mass of Resin Particles

Using gel permeation chromatography (GPC), a weight average molecular mass Mw and a count average molecular mass Mn were measured under conditions to be described below. At a temperature of 40 degrees Celsius, a solvent (tetrahydrofuran) was caused to flow at a speed of 1.2 milliliters per minute. 3 milligrams of tetrahydrofuran sample solution in a concentration of 0.2 gram/20 milliliters as a sample weight was injected, and a weight average molecular mass Mw and a count average molecular mass Mn were measured. Selected measurement conditions when the molecular masses of the sample were measured were those that allow the molecular mass of the sample to be included in a range where the logarithm and the count of the molecular mass plotted using several types of monodispersed polystyrenes reference samples become linear. The reliability of the measurement results can be confirmed when NBS706 monodispersed polystyrenes standard samples measured in the measurement conditions results in a weight average molecular mass Mw of $28.8\times10^4$ and a count average molecular mass Mn of $13.7\times10^4$. Furthermore, as a column used in the GPC, TSK-GEL and GMH (manufactured by Tosoh Corporation) satisfying the conditions are used.

Measuring Glass-Transition Temperature Tg of Resin

To measure the glass-transition temperature Tg of the resin, a differential scanning calorimeter (DSC) RDC220 (manufactured by Seiko Instruments, Inc.) was used. The diameter of the resin particles in the resin particle dispersion was measured using the laser diffraction granularity distribution meter (LA-920 manufactured by Horiba, Ltd.). The diameters of the toner particles, the carrier particles, and the recording agent are measured using a Coulter Multisizer II (manufactured by Beckman Coulter, Inc.).

Producing Resin Particle Dispersion (1)

A resin dispersion (1) of an ethylene-unsaturated compound polymer was prepared in the manner to be described below. To begin with, 300 parts by weight of ion-exchanged water and 1.5 parts by weight of tetradecyltrimethylammonium bromide (TTAB) (manufactured by Sigma-Aldrich Co. LLC.) were placed in a separable flask. After applying a nitrogen substitution for 20 minutes, the temperature was increased to 65 degrees Celsius while stirring. 40 parts by weight of an n-butyl acrylate monomer was then added, and stirred for 20 minutes. Then, 0.5 part by weight of polymerization initiator V-50 (2,2'-azobis(2-methyl propionamidine) dihydrochloride, manufactured by Wako Pure Chemical Industries, Ltd.) was dissolved into 10 parts by weight of ion-exchanged water in advance, and poured into the flask. After keeping the temperature at 65 degrees Celsius for three hours, 100 parts by weight of ion-exchanged water in which 61 parts by weight of styrene monomer, 9 parts by weight of n-butyl acrylate monomer, 2 parts by weight of acrylic acid, and 0.8 part by weight of dodecanethiol, and 0.5 part by weight of TTAB were dissolved was emulsified, and the emulsified liquid was kept poured into the flask over two hours using a titrating pump. The temperature is then increased to 70 degrees Celsius, kept for another two hours, and the polymerization was completed. Through this polymerization, a core-shell type resin particle dispersion (1) with a weight average molecular mass Mw of 25,000, and average particles diameter of 150 nanometers, and a solid content of 25 weight percent was acquired. After air-drying the resin particles at 40 degrees Celsius, a DSC analysis was performed in a temperature range from −80 degrees Celsius to 140 degrees Celsius. As a result, a glass-transition of the poly butyl acrylate was observed near −50 degrees Celsius. A glass-transition of a resin caused by a copolymer, probably a styrene-butyl acrylate-acrylic acid copolymer, was observed near 60 degrees Celsius.

Preparing Pigment Particle Dispersion (C1)

A pigment particle dispersion (C1) was prepared in the manner described below. As an example, preparation of a cyan pigment particle dispersion (C1) will be explained. 100 parts by weight of a cyan pigment (copper phthalocyanine and C. I. Pigment Blue 15:3 manufactured by Dainichi Seika Color & Chemicals Mfg. Co. Ltd.) and 10 parts by weight of anionic surface active agent (Neogen R manufactured by Dai-Ichi Kogyo Seiyaku Co., Ltd.) was mixed and dissolved into 400 parts by weight of ion-exchanged water. After dispersing with a homogenizer (Ultra-Turrax manufactured by IKA Works Inc.) for 15 minutes, the mixture was further dispersed for 10 minutes in an ultrasonic bath, to achieve a cyan pigment particle dispersion with a median diameter of 210 nanometers and a solid content of 21.5 percent.

Preparing Releasing Agent Particle Dispersion (R1)

A releasing agent particle dispersion (R1) was prepared in the manner described below. Two parts by weight of an anionic surface active agent (Neogen R manufactured by Dai-Ichi Kogyo Seiyaku Co., Ltd.) and 215 parts by weight of carnauba wax being constituents were mixed with 800 parts by weight of ion-exchanged water, and heated to melt at 100 degrees Celsius. After dispersing with a homogenizer (Ultra-Turrax manufactured by IKA Works Inc.) for 15 minutes, the mixture was emulsified using a Gaulin Homogenizer at 100 degrees Celsius. In this manner, a releasing agent particle dispersion with a particle median diameter of 230 nanometers, a melting point of 83 degrees Celsius, and a solid content of 21.5 percent was acquired.

Preparing and Producing Toner (1)

Using the various dispersions prepared in the manner described above, a toner (1) was produced in the manner described below. To begin with, 168 parts of the resin particle dispersion (1) (42 weight parts of the resin), 40 parts of the pigment particle dispersion (C1) (8.6 weight parts of the pigment), 80 parts of releasing agent particle dispersion (R1) (17.2 weight parts of the releasing agent), 0.15 part of poly aluminum chloride, and 300 parts by weight of ion-exchanged water were sufficiently mixed and dispersed in a round stainless flask using a homogenizer (Ultra-Turrax T50 manufactured by IKA Works Inc. IKA). The mixture was then heated to 42 degrees Celsius in a heating oil bath while stirring. After keeping the temperature at 42 degrees Celsius for 60 minutes, resin particle dispersion (1) was added by 84 parts by weight (21 parts by weight of the resin) and slowly stirred. After adjusting pH of the system to 6.0 in 0.5 mol/liter aqueous sodium hydroxide, the mixture was heated to 95 degrees Celsius while stirring continuously. At this time, the mixture was kept at 95 degrees Celsius for 3 hours while adding drops of aqueous sodium hydroxide so that pH was not reduced to equal to or less than 5.5. After the reaction completed, the mixture was cooled, filtered, and washed with ion-exchanged water sufficiently, and then separated into solid and liquid using a Nutsche suction filter. The solid component was then dispersed again in ion-exchanged water at 40 degrees Celsius, and stirred and washed at 300 rpm for 15 minutes. This washing operation was repeated five times, and the mixture was separated into solid and liquid using a Nutsche suction filter. The solid component was then dried for 12 hours in vacuum, to acquire the cyan toner particles (1). The volume average diameter of the toner particles measured by the Coulter counter was 5.8 micrometers.

1.5 parts by weight of hydrophobic silica (TS720 manufactured by Cabot Corporation) was added to 50 parts by weight of the toner. The toner was then mixed by a sample mill, to acquire cyan-colored toner (1).

Preparing Recording Agent (1)

To begin with, 100 parts by weight of silicon resin solution (KR50 manufactured by Shin-Etsu Chemical Co., Ltd.), 3 parts by weight of carbon black (BP2000 manufactured by Cabot Corporation), and 100 parts by weight of toluene were dispersed using a homomixer for 30 minutes, to prepare a covering layer forming solution. Using the covering layer forming solution and 1000 parts by weight of spherical ferrite carriers at an average particles diameter of 50 micrometers, spherical ferrite carriers with their surface applied with a covering layer using a fluid bed coater were manufactured. Then, 90 parts by weight of the toner and 910 parts by weight of the carrier were placed in a ball mill, stirred for 30 minutes, to produce the recording agent (1). Other three colors of yellow, magenta, and black recording agents (1) were produced in the same manner as the cyan toner (1), except that magenta pigment (C.I. pigment red 57:2), yellow pigment (C.I. pigment yellow 97), and black pigment (carbon black R330) were used, respectively, instead of the cyan pigment.

Producing Resin Particle Dispersion (2)

A resin particle dispersion (2) containing polyester resin was produced in the manner described below. Materials of 175 parts by weight of 1,4-cyclohexanedicarboxylic acid, 320 parts by weight of 2 mol ethylene oxide adduct of bisphenol A, 0.5 part by weight of dodecylbenzenesulfonic acid were mixed. The mixed materials were then placed into a reactor provided with a stirrer, and let it polycondensate in a nitrogen atmosphere for 12 hours in 120 degrees Celsius, to acquire polyester resin (1) that is uniformly transparent. The weight average molecular mass measured by the GPC was 14,000, and Tg measured by the DSC was 54 degrees Celsius.

Materials of 0.36 part by weight of dodecylbenzenesulfonic acid, 80 parts by weight of 1,6-hexanediol, and 115 parts by weight of sebacic acid were mixed, and placed in a reactor provided with a stirrer, and let it polycondensate in a nitrogen atmosphere for 5 hours in 90 degrees Celsius, to acquire polyester resin (2) that is uniformly white in color. The weight average molecular mass measured by the GPC was 8,000, and the DSC was −52 degrees Celsius.

Then, 100 parts by weight of the polyester resin (1) acquired by the polycondensation and the 100 parts by weight of polyester resin (2) was placed in a reactor provided with a stirrer, and dissolved and mixed for 30 minutes at 120 degrees Celsius. A neutralizing aqueous solution in which 1.0 part by weight of dodecylbenzenesulfonic acid sodium, 1.0 part by weight aqueous solution of 1NNaOH were dissolved into 800 parts by weight of ion-exchanged water heated to 95 degrees Celsius was placed in the flask, and emulsified for five minutes using a homogenizer (Ultra-Turrax manufactured by IKA Works Inc.). The flask was then shook in an ultrasonic bath for 10 minutes, and cooled by water at room temperature. The median diameter of the resin particles in the resin particle dispersion (2) thus acquired and containing 20 weight percent of solid content was 250 nanometers.

Preparing and Producing Toner (2)

Using the various dispersions prepared in the manner described above, a toner (2) was produced in the manner described below. 210 parts by weight of the resin particle dispersion (2) (42 parts by weight of the resin), 40 parts by weight of the pigment particle dispersion (C1) (8.6 parts by weight of pigment), 40 parts by weight of the releasing agent particle dispersion (R1) (8.6 parts by weight of the releasing agent), 0.15 part by weight of polyaluminum chloride, and 300 parts by weight of ion-exchanged water were sufficiently mixed and dispersed in a round stainless flask using a homogenizer (Ultra-Turrax T50 manufactured by IKA Works Inc.). The mixture was then heated to 42 degrees Celsius in a heating oil bath while stirring. After keeping the temperature at 42 degrees Celsius for 60 minutes, the resin particle dispersion (2) was added by 105 parts by weight (resin 21 parts by weight) and slowly stirred. After adjusting pH in the system to 6.0 in 0.5 mol/liter aqueous sodium hydroxide, the mixture was heated to 95 degrees Celsius while stirring continuously. While the temperature was increased to 95 degrees Celsius, drops of the aqueous sodium hydroxide were added so that pH was not reduced to equal to or less than 5.0. The mixture was then kept at 95 degrees Celsius for 3 hours. After the reaction completed, the mixture was cooled, filtered, and washed with ion-exchanged water sufficiently, and then separated into solid and liquid using a Nutsche suction filter. The solid component was then dispersed again into 3 liters of ion-exchanged water at 40 degrees Celsius, and stirred and washed at 300 rpm for 15 minutes. This washing operation was repeated five times, and the mixture was separated into solid and liquid using a Nutsche suction filter. The solid component was then dried for 12 hours in vacuum, to acquire the toner particles. The volume average diameter of the toner particles measured by the Coulter counter was 4.9 micrometers.

Then, 1.5 parts by weight of hydrophobic silica (TS720 manufactured by Cabot Corporation) was added to 50 parts by weight of the toner. The toner was then mixed by a sample mill, to acquire cyan-colored toner (2).

Preparing Recording Agent (2)

To begin with, 100 parts by weight of silicon resin solution (KR50 manufactured by Shin-Etsu Chemical Co., Ltd.), 3 parts by weight of carbon black (BP2000 manufactured by Cabot Corporation), and 100 parts by weight of toluene were dispersed using a homomixer for 30 minutes, to prepare a covering layer forming solution. Using 1000 parts by weight of the covering layer forming solution and spherical ferrite carriers at an average particles diameter of 50 micrometers, a covering layer was applied to the surfaces of the spherical ferrite carriers using a fluid bed coater. Then, 90 parts by weight of the toner and 910 parts by weight of the carrier were placed in a ball mill, stirred for 30 minutes, to produce a recording agent (2) for developing electrostatic charge. Other three colors of yellow, magenta, and black recording agents (2) were produced in the same manner as the cyan toner (2), except that magenta pigment (C.I. pigment red 57:2), yellow pigment (C.I. pigment yellow 97), and black pigment (carbon black R330) were used, respectively, instead of the cyan pigment.

Explained above is merely an example, and the present invention can achieve advantageous effects unique to the modes (1) to (7) described below.

(1)

An image forming method includes: forming a toner image on an image carrier such as the intermediate transfer belt 6; transferring the toner image formed on the image carrier onto a recording medium such as a transfer sheet; and transforming the toner image on the image carrier into a semi-film by applying a pressure.

Such a configuration enables the pressure applied to the toner image to be reduced, further enables a load applied to the image carrier to be reduced, compared with a technique in which a toner image on the image carrier is transformed into a film, as explained above in the embodiment. Furthermore, because the toner image having transformed into a semi-film is transferred onto a recording medium, toner scattering and incomplete images can be suppressed, compared with when a toner image without being transformed into a semi-film is transferred onto a recording medium.

(2)

The image forming method in the configuration described in (1) above further includes: forming a latent image on a latent image carrier such as a photosensitive element; developing the latent image formed on the latent image carrier into a toner image; and primarily transferring the toner image on the latent image carrier onto the image carrier; wherein the toner image is transformed into a semi-film after the primarily transferring and until the transferring.

Because the toner image is transformed into a semi-film after the toner image is primarily transferred, the oppositely charged toner attached to the non-image part of the latent image carrier can be suppressed from being transferred onto the image carrier, compared with when the toner image is transformed into a semi-film during the primary transfer. In this manner, smudges on the surface of the transfer sheet around images can be suppressed.

(3)

The image forming method in the configuration described in (2) above, wherein, at the primarily transferring, the toner image on the latent image carrier is electrostatically transferred onto the image carrier by generating an electrical field between the latent image carrier and the image carrier, while a pressure between the latent image carrier and the image carrier is kept at a level equal to or lower than a level at which the toner is plastically deformed, and at the transferring, the toner image on the image carrier is electrostatically transferred onto a recording medium by generating an electrical field between the image carrier and the recording medium, while keeping the pressure between the image carrier and the recording medium at a level equal to or higher than the level at which the toner is plastically deformed and a level equal to or lower than a level at which the toner image is transformed into a film so that the toner image is transformed into a semi-film.

Such a configuration enables the toner image to be electrostatically transferred onto the image carrier in the primary transfer unit. Because an electrostatic force toward the image carrier acts on oppositely charged toner attached to the non-image part of the latent image carrier, and because the pressure used in the primary transfer does not cause the toner to be plastically deformed, the oppositely charged toner is suppressed from mechanically adhering to the image carrier. In this manner, the oppositely charged toner can be suppressed from adhering to the image carrier well.

Furthermore, because the toner image can be transformed into a semi-film at the transferring, the number of parts can be reduced, compared with when the toner image is transformed into a semi-film at a step other than the transferring.

(4)

The image forming method in the configuration described in any one of (1) to (3) above, further includes fixing the toner image on the recording medium onto the recording medium using a pressure, or a pressure and heat.

In this manner, the toner image on the recording medium can be fixed onto the recording medium.

(5)

An image forming apparatus includes: an image carrier such as an intermediate transfer belt; a toner image forming unit that forms a toner image on the image carrier; a transfer unit that transfers the toner image formed on the image carrier onto a recording medium such as a transfer sheet; and a toner image transforming unit that transfers the toner image on the image carrier into a semi-film by applying a pressure to the toner image.

Such a configuration enables the pressure to be applied to the toner image to be reduced, and further enables a load applied to the image carrier to be reduced, compared with a technique in which a toner image on the image carrier is transformed into a film. Furthermore, because the toner image having transformed into a semi-film is transferred onto a recording medium, toner scattering and incomplete images can be suppressed, compared with when a toner image without being transformed into a semi-film is transferred onto a recording medium.

(6)

The image forming apparatus having the configuration described in (5) above, wherein the toner image forming unit includes: a latent image carrier such as a photosensitive element; a latent image forming unit (the charging unit 2 and the exposing unit in the embodiment) that forms a latent image on a latent image carrier; a developing unit as the developing unit 4 that develops the latent image formed on the latent image carrier into a toner image; and a primary transfer unit as the primary transfer unit that transfers the toner image formed on the latent image carrier onto the image carrier, wherein the primary transfer unit is configured to electrostatically transfer the toner image on the latent image carrier onto the image carrier by generating an electrical field between the latent image carrier and the image carrier, while keeping a pressure between the latent image carrier and the image carrier at a level equal to or lower than a level at which the toner is plastically deformed, and the transfer unit is configured to be used as a toner image transforming unit that transforms the toner image into a semi-film by keeping the pressure between the image carrier and the recording medium at a level equal to or higher than the level at which the toner is plastically deformed and equal to or lower than a level at which the toner image is transformed into a film, and to electrostatically transfer the toner image on the image carrier onto the recording medium by generating an electrical field between the image carrier and the recording medium.

Such a configuration enables the toner image to be electrostatically transferred onto the image carrier in the primary transfer unit. Because an electrostatic force toward the image carrier acts on oppositely charged toner attached to the non-image part of the latent image carrier, and because the pressure used in the primary transfer does not cause the toner to be plastically deformed, the oppositely charged toner is suppressed from mechanically adhering to the image carrier. In this manner, the oppositely charged toner can be suppressed from adhering to the image carrier well.

Furthermore, because the toner image can be transformed into a semi-film at the transferring, the number of parts can be reduced, compared with when the toner image is transformed into a semi-film at a step other than the transferring.

(7)

The image forming apparatus having the configuration described in (5) or (6) above, further comprises a fixing unit such as the fixing unit 11 that fixes the toner image on the recording medium onto the recording medium using a pressure, or a pressure and heat.

In this manner, the toner image on the recording medium can be fixed onto the recording medium.

According to the present invention, because the toner image on the image carrier is transformed into a semi-film, the pressure applied to the toner image can be reduced compared with when the toner image on the image carrier is transformed into a film. In this manner, compared with when the toner image on the image carrier is transformed into a film, a load of driving the image carrier can be reduced.

At a transferring step, because the toner image having transformed into a semi-film can be transferred onto a recording medium, toner scattering and incomplete images can be suppressed, compared with when a toner image not transformed into a semi-film is transferred onto a recording medium.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming method comprising:

forming a toner image on an image carrier including:

forming a latent image on a latent image carrier, developing the latent image formed on the latent image carrier into the toner image, and primarily transferring the toner image from the latent image carrier onto the image carrier;

transforming the toner image on the image carrier into a semi-film by applying a transforming pressure that is kept at a level equal to or higher than a level at which a toner of the toner image is plastically deformed and equal to or lower than a level at which the toner image is transformed into a film; and transferring the toner image formed on the image carrier onto a recording medium, wherein the toner image is transformed into the semi-film after the primarily transferring and before the transferring.

2. The image forming method according to claim 1, wherein at the primarily transferring, the toner image is electrostatically transferred from the latent image carrier onto the image carrier by generating an electrical field between the latent image carrier and the image carrier, while a pressure between the latent image carrier and the image carrier is kept at a level equal to or lower than the level at which the toner is plastically deformed, and wherein at the transferring, the toner image is electrostatically transferred from the image carrier onto a recording medium by generating an electrical field between the image carrier and the recording medium.

3. The image forming method according to claim 1, further comprising fixing the toner image as formed on the recording medium onto the recording medium using pressure, or a combination of pressure and heat.

4. The image forming method according to claim 1, wherein toner particles of the toner image as transformed into the semi-film are not completely fused.

5. An image forming apparatus comprising:

an image carrier;

a toner image forming unit configured to form a toner image on the image carrier and including:

a latent image carrier, a latent image forming unit configured to form a latent image on a latent image carrier, a developing unit configured to develop the latent image formed on the latent image carrier into the toner image, and a primary transfer unit configured to transfer the toner image from the latent image carrier onto the image carrier;

a transfer unit configured to:

be used as a toner image transforming unit configured to transform the toner image as formed on the image carrier into a semi-film by applying a transforming pressure to the toner image by keeping a pressure between the image carrier and the recording medium at a level equal to or higher than a level at which a toner of the toner image is plastically deformed and equal to or lower than a level at which the toner image is transformed into a film, and transfer the toner image from the image carrier onto a recording medium, wherein the primary transfer unit is configured to electrostatically transfer the toner image from the latent image carrier onto the image carrier by generating an electrical field between the latent image carrier and the image carrier, while keeping a pressure between the latent image carrier and the image carrier at a level equal to or lower than the level at which the toner is plastically deformed, and wherein the transfer unit is configured to electrostatically transfer the toner image from the image carrier onto the recording medium by generating an electrical field between the image carrier and the recording medium.

6. The image forming apparatus according to claim 5, further comprising a fixing unit configured to fix the toner image as formed on the recording medium onto the recording medium using pressure, or a combination of pressure and heat.

7. The image forming apparatus according to claim 5, wherein toner particles of the toner image as transformed into the semi-film are not completely fused.

8. An image forming apparatus comprising:

an image carrier;

a toner image forming unit configured to form a toner image on the image carrier and comprising:

a latent image carrier, a latent image forming unit configured to form a latent image on a latent image carrier, a developing unit configured to develop the latent image formed on the latent image carrier into the toner image, and a primary transfer unit configured to transfer the toner image from the latent image carrier onto the image carrier;

a toner image transforming unit configured to transform the toner image as formed on the image carrier into a semi-film by applying a transforming pressure to the toner image; and a transfer unit configured to transfer the toner image from the image carrier to a recording medium;

wherein the primary transfer unit is configured to electrostatically transfer the toner image from the latent image carrier to the image carrier by generating an electrical field between the latent image carrier and the image carrier, while keeping a pressure between the latent image carrier and the image carrier at a level equal to or lower than a level at which a toner of the toner image is plastically deformed, wherein the transfer unit is configured to be used as the toner image transforming unit that transforms the toner image into a semi-film by keeping a pressure between the image carrier and the recording medium at the transforming pressure, and to electrostatically transfer the toner image from the image carrier onto the recording medium by generating an electrical field between the image carrier and the recording medium, and wherein the transforming pressure is kept at a level equal to or higher than the level at which the toner is plastically deformed and equal to or lower than a level at which the toner image is transformed into a film.

* * * * *